US009633500B1

(12) United States Patent
Blake et al.

(10) Patent No.: US 9,633,500 B1
(45) Date of Patent: Apr. 25, 2017

(54) SYSTEMS, METHODS AND DEVICES FOR MANAGING REJECTED COINS DURING COIN PROCESSING

(71) Applicant: Cummins-Allison Corp., Mt. Prospect, IL (US)

(72) Inventors: John R. Blake, St. Charles, IL (US); Curtis W. Hallowell, Palatine, IL (US); Tomasz M. Jagielinski, Carlsbad, CA (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 15/219,837

(22) Filed: Jul. 26, 2016

Related U.S. Application Data

(63) Continuation of application No. 14/818,734, filed on Aug. 5, 2015, now Pat. No. 9,430,893.
(Continued)

(51) Int. Cl.
*G07D 7/00* (2016.01)
*G07F 7/04* (2006.01)
(Continued)

(52) U.S. Cl.
CPC ..... *G07D 3/16* (2013.01); *G07D 3/14* (2013.01); *G07D 5/00* (2013.01); *G07D 11/0069* (2013.01);
(Continued)

(58) Field of Classification Search
CPC ..... G07D 7/00; G07D 11/00; G07D 11/005; G07D 11/0069; G07D 11/0084;
(Continued)

(56) References Cited

U.S. PATENT DOCUMENTS 1,099,705 A 6/1914 Lindeen
2,570,920 A 10/1951 Clough et al. ..... 232/16
(Continued)

FOREIGN PATENT DOCUMENTS

CA 2235925 C 11/1995 ..... G07D 9/00
CA 2189330 C 12/2000 ..... G07F 17/42
(Continued)

OTHER PUBLICATIONS

Arniel Industries: AI-1500 'Pulsar' High Performance Sorting and Bagging Machine, 13 pages (date unknown, but prior to Dec. 14, 2000).

(Continued)

*Primary Examiner* — Mark Beauchaine
(74) *Attorney, Agent, or Firm* — Greer, Burns & Crain, Ltd.

(57) ABSTRACT

Currency processing systems, coin processing machines, computer-readable storage media, and methods of managing processed coins are presented herein. A method is presented for managing coins processed by a currency processing system. The method includes: receiving a batch of coins by the currency processing system; feeding the coins into a coin processing unit which includes one or more coin discriminating sensors; sorting the batch of coins into genuine fit target coins and reject coins; sorting the reject coins into a plurality of reject groups, each of which corresponds to a respective category of rejected coins; analyzing at least one of the reject groups to determine if any genuine target coins were mischaracterized and erroneously sorted into that reject group; and, crediting a user of the currency processing system for any genuine target coins in the reject group determined to have been mischaracterized and erroneously sorted.

40 Claims, 8 Drawing Sheets

Related U.S. Application Data

(60) Provisional application No. 62/033,936, filed on Aug. 6, 2014.

(51) Int. Cl.
*G07F 19/00* (2006.01)
*G07D 3/16* (2006.01)
*G07D 3/14* (2006.01)
*G07D 5/00* (2006.01)
*G07D 11/00* (2006.01)

(52) U.S. Cl.
CPC ..... *G07D 11/0084* (2013.01); *G07F 19/202* (2013.01)

(58) Field of Classification Search
CPC .... G07D 13/00; G07D 2211/00; G07F 19/00; G07F 19/202; G07F 7/04
See application file for complete search history.

(56) References Cited

U.S. PATENT DOCUMENTS 2,669,998 A 2/1954 Buchholz ..... 133/8
2,750,949 A 6/1956 Kulo et al. ..... 133/8
2,835,260 A 5/1958 Buchholz ..... 133/8
2,865,561 A 12/1958 Rosapepe ..... 232/7
3,132,654 A 5/1964 Adams ..... 133/1
3,376,970 A 4/1968 Roseberg ..... 198/40
3,771,583 A 11/1973 Bottemiller ..... 160/327
3,778,595 A 12/1973 Hatanaka et al. ..... 235/61.7 B
3,851,755 A 12/1974 Hull et al. ..... 206/0.82
3,916,922 A 11/1975 Prumm ..... 133/3 R
3,998,237 A 12/1976 Kressin ..... 133/3 A
3,998,379 A 12/1976 Myers et al. ..... 229/33
4,050,218 A 9/1977 Call ..... 53/167
4,059,122 A 11/1977 Kinoshita ..... 133/3 D
4,075,460 A 2/1978 Gorgens ..... 235/420
4,124,111 A 11/1978 Hayashi ..... 192/102
4,150,740 A 4/1979 Douno ..... 194/4 C
4,166,945 A 9/1979 Inoyama et al. ..... 235/379
4,172,462 A 10/1979 Uchida et al. ..... 133/3 A
4,179,685 A 12/1979 O'Maley ..... 340/146.3 H
4,179,723 A 12/1979 Spencer ..... 361/384
4,184,366 A 1/1980 Butler ..... 73/163
4,197,986 A 4/1980 Nagata ..... 235/379
4,208,549 A 6/1980 Polillo et al. ..... 179/6.3 R
4,228,812 A 10/1980 Marti ..... 133/3 F
4,232,295 A 11/1980 McConnell ..... 340/152 R
4,234,003 A 11/1980 Ristvedt et al. ..... 133/3
4,249,552 A 2/1981 Margolin et al. ..... 133/1 R
4,251,867 A 2/1981 Uchida et al. ..... 364/408
4,286,703 A 9/1981 Schuller et al. ..... 194/100 A
RE30,773 E 10/1981 Glaser et al. ..... 235/379
4,310,885 A 1/1982 Azcua et al. ..... 364/405
4,317,957 A 3/1982 Sendrow ..... 178/22.08
4,341,951 A 7/1982 Benton ..... 235/379
4,355,369 A 10/1982 Garvin ..... 364/900
4,360,034 A 11/1982 Davila et al. ..... 133/3 D
4,369,442 A 1/1983 Werth et al. ..... 340/825.35
4,380,316 A 4/1983 Glinka et al. ..... 232/16
4,383,540 A 5/1983 DeMeyer et al. ..... 133/3 H
4,385,285 A 5/1983 Horst et al. ..... 382/3
4,412,292 A 10/1983 Sedam et al. ..... 364/479
4,416,299 A 11/1983 Bergman ..... 133/1 R
4,417,136 A 11/1983 Rushby et al. ..... 235/379
4,423,316 A 12/1983 Sano et al. ..... 235/379
4,434,359 A 2/1984 Watanabe ..... 235/379
4,436,103 A 3/1984 Dick ..... 133/3 D
4,454,414 A 6/1984 Benton ..... 235/379
4,474,197 A 10/1984 Kinoshita et al. ..... 133/4 A
4,488,116 A 12/1984 Plesko ..... 324/236
4,531,531 A 7/1985 Johnson et al. ..... 133/3
4,542,287 A * 9/1985 Watanabe ..... G07D 11/0072 209/534
4,543,969 A 10/1985 Rasmussen ..... 133/3
4,549,561 A 10/1985 Johnson et al. ..... 133/3
4,556,140 A 12/1985 Okada ..... 194/4 C
4,558,711 A 12/1985 Yoshiaki et al. ..... 133/3 F
4,564,036 A 1/1986 Ristvedt ..... 133/3
4,570,655 A 2/1986 Raterman ..... 133/3
4,594,664 A 6/1986 Hashimoto ..... 364/405
4,602,332 A 7/1986 Hirose et al. ..... 364/408
4,607,649 A 8/1986 Taipale et al. ..... 133/3 C
4,620,559 A 11/1986 Childers et al. ..... 133/3 R
4,641,239 A 2/1987 Takesako ..... 364/408
4,674,260 A 6/1987 Rasmussen et al. ..... 53/212
4,681,128 A 7/1987 Ristvedt et al. ..... 453/6
4,705,154 A 11/1987 Masho et al. ..... 194/319
4,718,218 A 1/1988 Ristvedt ..... 206/0.82
4,731,043 A 3/1988 Ristvedt et al. ..... 453/6
4,733,765 A 3/1988 Watanabe ..... 194/206
4,749,074 A 6/1988 Ueki et al. ..... 194/317
4,753,624 A 6/1988 Adams et al. ..... 453/10
4,753,625 A 6/1988 Okada ..... 453/32
4,765,464 A 8/1988 Ristvedt ..... 206/0.82
4,766,548 A 8/1988 Cedrone et al. ..... 364/479
4,775,353 A 10/1988 Childers et al. ..... 453/6
4,775,354 A 10/1988 Rasmussen et al. ..... 453/10
4,778,983 A 10/1988 Ushikubo ..... 235/381
4,803,347 A 2/1989 Sugahara et al. ..... 235/379
4,804,830 A 2/1989 Miyagisima et al. ..... 235/379
4,812,629 A 3/1989 O'Neil et al. ..... 235/383
4,839,505 A 6/1989 Bradt et al. ..... 235/381
4,840,290 A 6/1989 Nakamura et al. ..... 221/10
4,844,369 A 7/1989 Kanayachi ..... 242/56 R
4,848,556 A 7/1989 Shah et al. ..... 194/212
4,863,414 A 9/1989 Ristvedt et al. ..... 453/6
4,883,158 A 11/1989 Kobayashi et al. ..... 194/217
4,884,212 A 11/1989 Stutsman ..... 364/479
4,900,909 A 2/1990 Nagashima et al. ..... 235/487
4,908,516 A 3/1990 West ..... 250/556
4,921,463 A 5/1990 Primdahl et al. ..... 453/3
4,936,435 A 6/1990 Griner ..... 194/317
4,953,086 A 8/1990 Fukatsu ..... 364/408
4,954,697 A 9/1990 Kokubun et al. ..... 235/381
4,964,495 A 10/1990 Rasmussen ..... 194/344
4,966,570 A 10/1990 Ristvedt et al. ..... 453/6
4,970,655 A 11/1990 Winn et al. ..... 364/479
4,971,187 A 11/1990 Furuya et al. ..... 194/318
4,988,849 A 1/1991 Sasaki et al. ..... 235/379
4,992,647 A 2/1991 Konishi et al. ..... 235/379
4,995,848 A 2/1991 Goh ..... 453/3
5,009,627 A 4/1991 Rasmussen ..... 453/10
5,010,238 A 4/1991 Kadono et al. ..... 235/379
5,010,485 A 4/1991 Bigari ..... 364/408
5,011,455 A 4/1991 Rasmussen ..... 453/10
5,022,889 A 6/1991 Ristvedt et al. ..... 453/6
5,025,139 A 6/1991 Halliburton, Jr. ..... 235/379
5,026,320 A 6/1991 Rasmussen ..... 453/6
5,031,098 A 7/1991 Miller et al. ..... 364/405
5,033,602 A 7/1991 Saarinen et al. ..... 194/334
5,039,848 A 8/1991 Stoken ..... 235/381
5,055,086 A 10/1991 Raterman et al. ..... 453/10
5,055,657 A 10/1991 Miller et al. ..... 235/381
5,056,643 A 10/1991 Kirberg ..... 194/202
5,064,999 A 11/1991 Okamoto et al. ..... 235/379
5,067,928 A 11/1991 Harris ..... 453/17
5,080,633 A 1/1992 Ristvedt et al. ..... 435/6
5,091,713 A 2/1992 Horne et al. ..... 340/541
5,104,353 A 4/1992 Ristvedt et al. ..... 453/6
5,105,601 A 4/1992 Horiguchi et al. ..... 53/465
5,106,338 A 4/1992 Rasmussen et al. ..... 453/10
5,111,927 A 5/1992 Schulze ..... 194/209
5,114,381 A 5/1992 Ueda et al. ..... 453/57
5,120,945 A 6/1992 Nishibe et al. ..... 235/379
5,123,873 A 6/1992 Rasmussen ..... 453/10
5,129,205 A 7/1992 Rasmussen ..... 53/52
5,135,435 A 8/1992 Rasmussen ..... 453/56
5,140,517 A 8/1992 Nagata et al. ..... 364/408
5,141,443 A 8/1992 Rasmussen et al. ..... 453/10
5,141,472 A 8/1992 Todd et al. ..... 453/10
5,145,455 A 9/1992 Todd ..... 453/6
5,146,067 A 9/1992 Sloan et al. ..... 235/381

(56) References Cited

U.S. PATENT DOCUMENTS

| | | | | |
|---|---|---|---|---|
| 5,154,272 | A | 10/1992 | Nishiumi et al. | 194/318 |
| 5,163,866 | A | 11/1992 | Rasmussen | 453/10 |
| 5,163,867 | A | 11/1992 | Rasmussen | 453/10 |
| 5,163,868 | A | 11/1992 | Adams et al. | 453/11 |
| 5,167,313 | A | 12/1992 | Dobbins et al. | 194/317 |
| 5,175,416 | A | 12/1992 | Mansvelt et al. | 235/379 |
| 5,176,565 | A | 1/1993 | Ristvedt et al. | 453/6 |
| 5,179,517 | A | 1/1993 | Sarbin et al. | 364/410 |
| 5,183,142 | A | 2/1993 | Latchinian et al. | 194/206 |
| 5,184,709 | A | 2/1993 | Nishiumi et al. | 194/318 |
| 5,194,037 | A | 3/1993 | Jones et al. | 453/10 |
| 5,197,919 | A | 3/1993 | Geib et al. | 453/10 |
| 5,205,780 | A | 4/1993 | Rasmussen | 453/10 |
| 5,207,784 | A | 5/1993 | Schwartzendruber | 221/6 |
| 5,209,696 | A | 5/1993 | Rasmussen et al. | 453/10 |
| 5,236,071 | A | 8/1993 | Lee | 194/200 |
| 5,243,174 | A | 9/1993 | Veeneman et al. | 235/381 |
| 5,251,738 | A | 10/1993 | Dabrowski | 194/206 |
| 5,252,811 | A | 10/1993 | Henochowicz et al. | 235/379 |
| 5,253,167 | A | 10/1993 | Yoshida et al. | 364/408 |
| 5,259,491 | A | 11/1993 | Ward II | 194/350 |
| 5,263,566 | A | 11/1993 | Nara et al. | 194/318 |
| 5,265,874 | A | 11/1993 | Dickinson et al. | 273/138 A |
| 5,268,561 | A | 12/1993 | Kimura et al. | 235/384 |
| 5,277,651 | A | 1/1994 | Rasmussen et al. | 453/10 |
| 5,282,127 | A | 1/1994 | Mii | 364/130 |
| 5,286,226 | A | 2/1994 | Rasmussen | 453/10 |
| 5,286,954 | A | 2/1994 | Sato et al. | 235/379 |
| 5,291,003 | A | 3/1994 | Avnet et al. | 235/381 |
| 5,291,560 | A | 3/1994 | Daugman | 382/2 |
| 5,293,981 | A | 3/1994 | Abe et al. | 194/345 |
| 5,297,030 | A | 3/1994 | Vassigh et al. | 364/405 |
| 5,297,598 | A | 3/1994 | Rasmussen | 141/314 |
| 5,297,986 | A | 3/1994 | Ristvedt et al. | 453/6 |
| 5,299,977 | A | 4/1994 | Mazur et al. | 453/10 |
| 5,302,811 | A | 4/1994 | Fukatsu | 235/381 |
| 5,324,922 | A | 6/1994 | Roberts | 235/375 |
| 5,326,104 | A | 7/1994 | Pease et al. | 273/138 A |
| 5,370,575 | A | 12/1994 | Geib et al. | 453/3 |
| 5,372,542 | A | 12/1994 | Geib et al. | 453/10 |
| 5,374,814 | A | 12/1994 | Kako et al. | 235/379 |
| 5,379,344 | A | 1/1995 | Larsson et al. | 380/23 |
| 5,379,875 | A | 1/1995 | Shames et al. | 194/317 |
| 5,382,191 | A | 1/1995 | Rasmussen | 453/11 |
| 5,390,776 | A | 2/1995 | Thompson | 194/346 |
| 5,401,211 | A | 3/1995 | Geib et al. | 453/10 |
| 5,404,986 | A | 4/1995 | Hossfield et al. | 194/317 |
| 5,410,590 | A | 4/1995 | Blood et al. | 379/147 |
| RE34,934 | E | 5/1995 | Raterman et al. | 453/10 |
| 5,425,669 | A | 6/1995 | Geib et al. | 453/10 |
| 5,429,550 | A | 7/1995 | Mazur et al. | 453/10 |
| 5,440,108 | A | 8/1995 | Tran et al. | 235/381 |
| 5,443,419 | A | 8/1995 | Adams et al. | 453/17 |
| 5,450,938 | A | 9/1995 | Rademacher | 194/206 |
| 5,453,047 | A | 9/1995 | Mazur et al. | 453/10 |
| 5,458,285 | A | 10/1995 | Remien | 232/15 |
| 5,468,182 | A | 11/1995 | Geib | 453/10 |
| 5,470,079 | A | 11/1995 | LeStrange et al. | 273/138 A |
| 5,474,495 | A | 12/1995 | Geib et al. | 453/3 |
| 5,474,497 | A | 12/1995 | Jones et al. | 453/17 |
| 5,480,348 | A | 1/1996 | Mazur et al. | 453/10 |
| 5,489,237 | A | 2/1996 | Geib et al. | 453/12 |
| 5,500,514 | A | 3/1996 | Veeneman et al. | 235/381 |
| 5,501,631 | A | 3/1996 | Mennie et al. | 453/3 |
| 5,507,379 | A | 4/1996 | Mazur et al. | 194/318 |
| 5,514,034 | A | 5/1996 | Jones et al. | 453/10 |
| 5,520,577 | A | 5/1996 | Rasmussen | 453/56 |
| 5,531,309 | A | 7/1996 | Kloss et al. | 194/202 |
| 5,538,468 | A | 7/1996 | Ristvedt et al. | 453/3 |
| 5,542,880 | A | 8/1996 | Geib et al. | 453/10 |
| 5,542,881 | A | 8/1996 | Geib | 453/10 |
| 5,553,320 | A | 9/1996 | Matsuura et al. | 235/379 |
| 5,559,887 | A | 9/1996 | Davis et al. | 380/24 |
| 5,564,546 | A | 10/1996 | Molbak et al. | 194/216 |
| 5,564,974 | A | 10/1996 | Mazur et al. | 453/10 |
| 5,564,978 | A | 10/1996 | Jones et al. | 453/17 |
| 5,570,465 | A | 10/1996 | Tsakanikas | 395/114 |
| 5,573,457 | A | 11/1996 | Watts et al. | 453/31 |
| 5,584,758 | A | 12/1996 | Geib | 453/10 |
| 5,592,377 | A | 1/1997 | Lipkin | 395/242 |
| 5,602,933 | A | 2/1997 | Blackwell et al. | 382/116 |
| 5,615,625 | A | 4/1997 | Cassidy et al. | 109/45 |
| 5,620,079 | A | 4/1997 | Molbak | 194/217 |
| 5,623,547 | A | 4/1997 | Jones et al. | 380/24 |
| 5,625,562 | A | 4/1997 | Veeneman et al. | 364/479.05 |
| 5,630,494 | A | 5/1997 | Strauts | 194/317 |
| 5,641,050 | A | 6/1997 | Smith et al. | 194/210 |
| 5,650,605 | A | 7/1997 | Morioka et al. | 235/379 |
| 5,650,761 | A | 7/1997 | Gomm et al. | 235/381 |
| 5,652,421 | A | 7/1997 | Veeneman et al. | 235/381 |
| 5,665,952 | A | 9/1997 | Ziarno | 235/380 |
| 5,679,070 | A | 10/1997 | Ishida et al. | 453/41 |
| 5,684,597 | A | 11/1997 | Hossfield et al. | 356/384 |
| 5,696,366 | A | 12/1997 | Ziarno | 235/380 |
| 5,743,373 | A | 4/1998 | Strauts | 194/318 |
| 5,746,299 | A | 5/1998 | Molbak et al. | 194/200 |
| 5,774,874 | A | 6/1998 | Veeneman et al. | 705/27 |
| 5,782,686 | A | 7/1998 | Geib et al. | 453/10 |
| 5,799,767 | A | 9/1998 | Molbak | 194/217 |
| 5,813,510 | A | 9/1998 | Rademacher | 194/206 |
| 5,823,315 | A | 10/1998 | Hoffman et al. | 194/203 |
| 5,830,054 | A | 11/1998 | Petri | 453/5 |
| 5,838,812 | A | 11/1998 | Pare, Jr. et al. | 382/115 |
| 5,842,188 | A | 11/1998 | Ramsey et al. | 705/416 |
| 5,842,916 | A | 12/1998 | Gerrity et al. | 453/57 |
| 5,850,076 | A | 12/1998 | Morioka et al. | 235/379 |
| 5,854,581 | A | 12/1998 | Mori et al. | 235/379 |
| 5,865,673 | A | 2/1999 | Geib et al. | 453/10 |
| 5,875,879 | A | 3/1999 | Hawthorn | 194/350 |
| 5,880,444 | A | 3/1999 | Shibata et al. | 235/379 |
| 5,892,211 | A | 4/1999 | Davis et al. | 235/380 |
| 5,892,827 | A | 4/1999 | Beach et al. | 380/24 |
| 5,909,793 | A | 6/1999 | Beach et al. | 194/210 |
| 5,909,794 | A | 6/1999 | Molbak et al. | 194/216 |
| 5,913,399 | A | 6/1999 | Takemoto et al. | 194/200 |
| 5,918,748 | A | 7/1999 | Clark et al. | 209/534 |
| 5,940,623 | A | 8/1999 | Watts et al. | 395/712 |
| 5,941,364 | A | 8/1999 | Wei | 194/350 |
| 5,944,162 | A | 8/1999 | Filiberti | 194/204 |
| 5,944,600 | A | 8/1999 | Zimmermann | 435/10 |
| 5,944,601 | A | 8/1999 | Hayashi et al. | 453/61 |
| 5,951,476 | A | 9/1999 | Beach et al. | 600/437 |
| 5,957,262 | A | 9/1999 | Molbak et al. | 194/200 |
| 5,988,348 | A | 11/1999 | Martin et al. | 194/317 |
| 5,995,949 | A | 11/1999 | Morioka et al. | 705/43 |
| 5,997,395 | A | 12/1999 | Geib et al. | 453/10 |
| 6,017,270 | A | 1/2000 | Ristvedt et al. | 453/5 |
| 6,021,883 | A | 2/2000 | Casanova et al. | 194/217 |
| 6,032,859 | A | 3/2000 | Muehlberger et al. | 235/449 |
| 6,039,644 | A | 3/2000 | Geib et al. | 453/10 |
| 6,039,645 | A | 3/2000 | Mazur | 453/10 |
| 6,042,470 | A | 3/2000 | Geib et al. | 453/10 |
| 6,047,807 | A | 4/2000 | Molbak | 194/217 |
| 6,047,808 | A | 4/2000 | Neubarth et al. | 194/317 |
| 6,056,104 | A | 5/2000 | Neubarth et al. | 194/317 |
| 6,068,194 | A | 5/2000 | Mazur | 235/492 |
| 6,080,056 | A | 6/2000 | Karlsson | 453/3 |
| 6,082,519 | A | 7/2000 | Martin et al. | 194/350 |
| 6,086,471 | A | 7/2000 | Zimmermann | 453/3 |
| 6,095,313 | A | 8/2000 | Molbak et al. | 194/344 |
| 6,116,402 | A | 9/2000 | Beach et al. | 194/216 |
| 6,131,625 | A | 10/2000 | Casanova et al. | 141/314 |
| 6,139,418 | A | 10/2000 | Geib et al. | 453/10 |
| 6,142,285 | A | 11/2000 | Panzeri et al. | 194/328 |
| 6,145,738 | A | 11/2000 | Stinson et al. | 235/379 |
| 6,154,879 | A | 11/2000 | Pare, Jr. et al. | 902/3 |
| 6,168,001 | B1 | 1/2001 | Davis | 194/200 |
| 6,171,182 | B1 | 1/2001 | Geib et al. | 453/10 |
| 6,174,230 | B1 | 1/2001 | Gerrity et al. | 453/57 |
| 6,196,371 | B1 | 3/2001 | Martin et al. | 194/317 |
| 6,196,913 | B1 | 3/2001 | Geib et al. | 453/10 |
| 6,202,006 | B1 | 3/2001 | Scott | 700/231 |
| 6,213,277 | B1 | 4/2001 | Blad et al. | 194/350 |
| 6,230,928 | B1 | 5/2001 | Hanna et al. | 221/13 |

(56) References Cited

U.S. PATENT DOCUMENTS 6,264,545 B1 7/2001 Magee et al. ..... 453/3
6,308,887 B1 10/2001 Korman et al. ..... 235/379
6,318,536 B1 11/2001 Korman et al. ..... 194/217
6,318,537 B1 11/2001 Jones et al. ..... 194/346
6,349,972 B1 2/2002 Geiger et al. ..... 283/67
6,386,323 B1 5/2002 Ramachandran et al. ..... 186/36
6,412,620 B1 7/2002 Imura ..... 194/317
6,431,342 B1 8/2002 Schwartz ..... 194/346
6,438,230 B1 8/2002 Moore ..... 380/42
6,456,928 B1 9/2002 Johnson ..... 701/114
6,471,030 B1 10/2002 Neubarth et al. ..... 194/317
6,474,548 B1 11/2002 Montross et al. ..... 235/379
6,484,863 B1 11/2002 Molbak ..... 194/216
6,484,884 B1 11/2002 Gerrity et al. ..... 209/233
6,494,776 B1 12/2002 Molbak ..... 453/32
6,499,277 B1 12/2002 Warner et al. ..... 53/447
6,503,138 B2 1/2003 Spoehr et al. ..... 453/10
6,520,308 B1 2/2003 Martin et al. ..... 194/317
6,522,772 B1 2/2003 Morrison et al. ..... 382/124
6,547,131 B1 4/2003 Foodman et al. ..... 235/380
6,552,781 B1 4/2003 Rompel et al. ..... 256/71
6,554,185 B1 4/2003 Montross et al. ..... 235/379
6,579,165 B2 6/2003 Kuhlin et al. ..... 453/3
6,581,042 B2 6/2003 Pare, Jr. et al. ..... 705/40
6,602,125 B2 8/2003 Martin ..... 453/12
6,609,604 B1 8/2003 Jones et al. ..... 194/302
6,612,921 B2 9/2003 Geib et al. ..... 453/13
6,637,576 B1 10/2003 Jones et al. ..... 194/216
6,640,956 B1 11/2003 Zwieg et al. ..... 194/328
6,644,696 B2 11/2003 Brown et al. ..... 283/67
6,652,380 B1 11/2003 Luciano ..... 463/25
6,655,585 B2 12/2003 Shinn ..... 235/382
6,659,259 B2 12/2003 Knox et al. ..... 194/217
6,662,166 B2 12/2003 Pare, Jr. et al. ..... 705/39
6,663,675 B2 12/2003 Blake et al. ..... 753/63
6,666,318 B2 12/2003 Gerrity et al. ..... 194/347
6,719,121 B2 4/2004 Alexander et al. ..... 194/350
6,755,730 B2 6/2004 Geib et al. ..... 453/3
6,758,316 B2 7/2004 Molbak ..... 194/200
6,761,308 B1 7/2004 Hanna et al. ..... 235/379
6,766,892 B2 7/2004 Martin et al. ..... 194/317
6,783,452 B2 8/2004 Hino et al. ..... 453/3
6,786,398 B1 9/2004 Stinson et al. ..... 235/379
6,854,581 B2 2/2005 Molbak ..... 194/344
6,854,640 B2 2/2005 Peklo ..... 235/100
6,863,168 B1 3/2005 Gerrity et al. ..... 194/347
6,892,871 B2 5/2005 Strauts et al. ..... 194/302
6,896,118 B2 5/2005 Jones et al. ..... 194/217
6,928,546 B1 8/2005 Nanavati et al. ..... 713/186
6,950,810 B2 9/2005 Lapsley et al. ..... 705/78
6,953,150 B2 10/2005 Shepley et al. ..... 235/379
6,957,746 B2 10/2005 Martin et al. ..... 221/131
6,966,417 B2 11/2005 Peklo et al. ..... 194/344
6,976,570 B2 12/2005 Molbak ..... 194/215
6,988,606 B2 1/2006 Geib et al. ..... 194/334
6,991,530 B2 1/2006 Hino et al. ..... 453/3
7,004,831 B2 2/2006 Hino et al. ..... 453/5
7,014,029 B2 3/2006 Winters ..... 194/302
7,014,108 B2 3/2006 Sorenson et al. ..... 235/381
7,017,729 B2 3/2006 Gerrity et al. ..... 194/347
7,018,286 B2 3/2006 Blake et al. ..... 453/61
7,028,827 B1 4/2006 Molbak et al. ..... 194/346
7,036,651 B2 5/2006 Tam et al. ..... 194/217
7,083,036 B2 8/2006 Adams ..... 194/223
7,113,929 B1 9/2006 Beach et al. ..... 705/65
7,131,580 B2 11/2006 Molbak ..... 235/379
7,149,336 B2 12/2006 Jones et al. ..... 382/135
7,152,727 B2 12/2006 Waechter ..... 194/317
7,158,662 B2 1/2007 Chiles ..... 382/135
7,188,720 B2 3/2007 Geib et al. ..... 194/302
7,213,697 B2 5/2007 Martin et al. ..... 194/317
7,225,911 B2 * 6/2007 Yokoi ..... G07D 11/0051 194/205
7,243,773 B2 7/2007 Bochonok et al. ..... 194/350
7,269,279 B2 9/2007 Chiles ..... 382/135
7,303,119 B2 12/2007 Molbak ..... 235/379
7,331,521 B2 2/2008 Sorenson et al. ..... 235/381
7,337,890 B2 3/2008 Bochonok et al. ..... 194/353
7,427,230 B2 9/2008 Blake et al. ..... 453/63
7,438,172 B2 10/2008 Long et al. ..... 194/347
7,464,802 B2 12/2008 Gerrity et al. ..... 194/347
7,500,568 B2 3/2009 Cousin ..... 209/534
7,520,374 B2 4/2009 Martin et al. ..... 194/317
7,551,764 B2 6/2009 Chiles et al. ..... 382/135
7,552,810 B2 6/2009 Mecklenburg ..... 194/317
7,580,859 B2 8/2009 Economy ..... 705/16
7,604,107 B2 10/2009 Richard et al. ..... 194/351
7,654,450 B2 2/2010 Mateen et al. ..... 235/379
7,658,270 B2 2/2010 Bochonok et al. ..... 194/350
7,735,125 B1 6/2010 Alvarez et al. ..... 726/9
7,743,902 B2 6/2010 Wendell et al. ..... 194/302
7,778,456 B2 8/2010 Jones et al. ..... 382/135
7,819,308 B2 10/2010 Osterberg et al. ..... 235/379
7,874,478 B2 1/2011 Molbak ..... 235/379
7,886,890 B2 2/2011 Blake et al. ..... 194/347
7,931,304 B2 4/2011 Brown et al. ..... 283/57
7,946,406 B2 5/2011 Blake et al. ..... 194/200
7,949,582 B2 5/2011 Mennie et al. ..... 705/35
7,963,382 B2 6/2011 Wendell et al. ..... 194/302
7,980,378 B2 7/2011 Jones et al. ..... 194/217
8,023,715 B2 9/2011 Jones et al. ..... 382/135
8,042,732 B2 10/2011 Blake et al. ..... 235/375
8,229,821 B2 7/2012 Mennie et al. ..... 232/16
8,346,610 B2 1/2013 Mennie et al. ..... 705/16
8,352,322 B2 1/2013 Mennie et al. ..... 705/16
8,393,455 B2 3/2013 Blake et al. ..... 194/350
8,443,958 B2 5/2013 Jones et al. ..... 194/215
RE44,252 E 6/2013 Jones et al. ..... 194/217
8,523,641 B2 9/2013 Kuykendall et al. ..... 194/217
8,545,295 B2 10/2013 Blake et al. ..... 453/4
8,602,200 B2 12/2013 Blake ..... 194/216
8,607,957 B2 12/2013 Blake et al. ..... 194/344
8,616,359 B2 12/2013 Bochonok et al. ..... 194/202
RE44,689 E 1/2014 Wendell et al. ..... 194/302
8,684,159 B2 4/2014 Blake ..... 194/216
8,684,160 B2 4/2014 Hallowell et al. ..... 194/344
8,701,860 B1 4/2014 Blake et al. ..... 194/350
8,950,566 B2 2/2015 Hallowell et al. ..... 194/206
8,959,029 B2 2/2015 Jones et al. ..... 705/18
9,092,924 B1 7/2015 Rasmussen et al. ..... 453/3
9,330,515 B1 5/2016 Rasmussen et al. ..... 453/3
9,430,893 B1 8/2016 Blake et al. ..... G07D 3/16
9,437,069 B1 9/2016 Blake et al. ..... G07D 13/00
9,501,885 B1 11/2016 Yacoubian et al. ..... G07D 3/14
9,508,208 B1 11/2016 Jagielinski et al. ..... G07D 3/14
2001/0034203 A1 10/2001 Geib et al. ..... 453/3
2001/0048025 A1 12/2001 Shinn ..... 235/382
2002/0065033 A1 5/2002 Geib et al. ..... 453/3
2002/0069104 A1 6/2002 Beach et al. ..... 705/14
2002/0074209 A1 6/2002 Karlsson ..... 194/330
2002/0085745 A1 7/2002 Jones et al. ..... 382/135
2002/0095587 A1 7/2002 Doyle et al. ..... 713/186
2002/0107738 A1 8/2002 Beach et al. ..... 705/14
2002/0126885 A1 9/2002 Mennie et al. ..... 382/135
2002/0130011 A1 9/2002 Casanova et al. ..... 194/344
2002/0147588 A1 10/2002 Davis et al. ..... 704/246
2002/0151267 A1 10/2002 Kuhlin et al. ..... 453/3
2002/0174348 A1 11/2002 Ting ..... 713/186
2002/0179401 A1 12/2002 Knox et al. ..... 194/217
2003/0004878 A1 1/2003 Akutsu et al. ..... 705/43
2003/0013403 A1 1/2003 Blake et al. ..... 453/60
2003/0042110 A1 3/2003 Wilfong ..... 194/302
2003/0081824 A1 5/2003 Mennie et al. ..... 382/135
2003/0127299 A1 7/2003 Jones et al. ..... 194/217
2003/0168309 A1 9/2003 Geib et al. ..... 194/302
2003/0168310 A1 9/2003 Strauts et al. ..... 194/302
2003/0182217 A1 9/2003 Chiles ..... 705/35
2003/0190882 A1 10/2003 Blake et al. ..... 453/63
2003/0230464 A1 12/2003 Deaville et al. ..... 194/302
2003/0234153 A1 12/2003 Blake et al. ..... 194/347
2004/0021898 A1 2/2004 Ashizaki ..... 358/1.15
2004/0055902 A1 3/2004 Peklo ..... 206/0.815
2004/0092222 A1 5/2004 Kowalczyk et al. ..... 453/12
2004/0153406 A1 8/2004 Alarcon-Luther et al. ..... 705/41

(56) References Cited

U.S. PATENT DOCUMENTS

| | | | | |
|---|---|---|---|---|
| 2004/0153421 | A1 | 8/2004 | Robinson | 705/75 |
| 2004/0154899 | A1 | 8/2004 | Peklo et al. | 193/33 |
| 2004/0173432 | A1 | 9/2004 | Jones | 194/216 |
| 2004/0188221 | A1 | 9/2004 | Carter | 194/215 |
| 2004/0195302 | A1 | 10/2004 | Washington et al. | 232/15 |
| 2004/0199924 | A1 | 10/2004 | Ganesh et al. | 719/313 |
| 2004/0200691 | A1 | 10/2004 | Geib et al. | 194/302 |
| 2004/0238319 | A1 | 12/2004 | Hand et al. | 194/207 |
| 2004/0238614 | A1 | 12/2004 | Yoshioka et al. | 232/7 |
| 2004/0256197 | A1 | 12/2004 | Blake et al. | 194/350 |
| 2005/0006197 | A1 | 1/2005 | Wendell et al. | 194/302 |
| 2005/0035140 | A1 | 2/2005 | Carter | 221/195 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0067305 | A1 | 3/2005 | Bochonok et al. | 206/8 |
| 2005/0077142 | A1 | 4/2005 | Tam et al. | 194/217 |
| 2005/0086140 | A1 | 4/2005 | Ireland et al. | 705/35 |
| 2005/0087425 | A1 | 4/2005 | Peklo | 194/350 |
| 2005/0096986 | A1 | 5/2005 | Taylor et al. | 705/16 |
| 2005/0098625 | A1 | 5/2005 | Walker et al. | 235/381 |
| 2005/0108165 | A1 | 5/2005 | Jones et al. | 705/43 |
| 2005/0109836 | A1 | 5/2005 | Ben-Aissa | 235/380 |
| 2005/0121507 | A1 | 6/2005 | Brown et al. | 235/379 |
| 2005/0124407 | A1 | 6/2005 | Rowe | 463/25 |
| 2005/0150740 | A1 | 7/2005 | Finkenzeller et al. | 194/207 |
| 2005/0156318 | A1 | 7/2005 | Douglas | 257/761 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0256792 | A1 | 11/2005 | Shimizu et al. | 705/35 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0065717 | A1 | 3/2006 | Hurwitz et al. | 235/381 |
| 2006/0069654 | A1 | 3/2006 | Beach et al. | 705/65 |
| 2006/0146839 | A1 | 7/2006 | Hurwitz et al. | 370/401 |
| 2006/0148394 | A1 | 7/2006 | Blake et al. | 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2006/0253332 | A1 | 11/2006 | Dobbins | 705/21 |
| 2006/0283685 | A1 | 12/2006 | Cousin | 194/217 |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1 | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0251800 | A1 | 11/2007 | Castleberry | 194/219 |
| 2007/0269097 | A1 | 11/2007 | Chiles et al. | 382/135 |
| 2007/0270997 | A1 | 11/2007 | Brumfield et al. | 700/214 |
| 2008/0033829 | A1 | 2/2008 | Mennie et al. | 705/16 |
| 2008/0044077 | A1 | 2/2008 | Mennie et al. | 382/135 |
| 2008/0135608 | A1 | 6/2008 | Ireland et al. | 232/1 D |
| 2008/0220707 | A1 | 9/2008 | Jones et al. | 453/2 |
| 2008/0223930 | A1 | 9/2008 | Rolland et al. | 235/385 |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0065623 | A1 | 3/2010 | Sauter | 232/1 D |
| 2010/0198726 | A1 | 8/2010 | Doran et al. | 705/41 |
| 2010/0234985 | A1 | 9/2010 | Shuren et al. | 700/223 |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Mennie et al. | 700/223 |
| 2011/0099105 | A1 | 4/2011 | Mennie et al. | 705/41 |
| 2011/0259961 | A1 | 10/2011 | Folk et al. | 235/385 |
| 2011/0270695 | A1 | 11/2011 | Jones et al. | 705/43 |
| 2012/0067950 | A1 | 3/2012 | Blake | 235/381 |
| 2012/0156976 | A1 | 6/2012 | Blake et al. | 453/4 |
| 2013/0178139 | A1 | 7/2013 | Hallowell et al. | 453/15 |
| 2013/0199890 | A1 | 8/2013 | Blake | 194/216 |
| 2013/0205723 | A1 | 8/2013 | Blake et al. | 53/473 |
| 2014/0335770 | A1* | 11/2014 | Martin | G07D 3/00 453/3 |
| 2015/0302678 | A1 | 10/2015 | Blake et al. | |

FOREIGN PATENT DOCUMENTS

| | | | | |
|---|---|---|---|---|
| CA | 2143943 | C | 3/2003 | G07D 3/16 |
| DE | 06 60 354 | | 5/1938 | G07F 17/26 |
| DE | 30 21 327 | A1 | 12/1981 | G07D 3/06 |
| EP | 0 351 217 | A2 | 1/1990 | G07F 9/04 |
| EP | 0 667 973 | B1 | 1/1997 | G07D 3/14 |
| EP | 0 926 634 | A2 | 6/1999 | G07D 3/14 |
| EP | 1 104 920 | A1 | 6/2001 | G07D 5/08 |
| EP | 1 209 639 | A2 | 5/2002 | G07F 19/00 |
| EP | 1 528 513 | A1 | 5/2005 | G07F 7/08 |
| FR | 2042254 | | 2/1971 | G07B 11/00 |
| GB | 2035642 | A | 6/1980 | G07F 7/10 |
| GB | 2175427 | A | 11/1986 | G07F 17/42 |
| GB | 2198274 | A | 6/1988 | G07D 3/00 |
| GB | 2458387 | A | 9/2009 | G07D 11/00 |
| GB | 2468783 | A | 9/2010 | C07D 9/00 |
| JP | 49-058899 | | 6/1974 | |
| JP | 52-014495 | | 2/1977 | G07F 5/10 |
| JP | 52-071300 | A | 6/1977 | G07F 5/22 |
| JP | 56-040992 | A | 4/1981 | G07F 5/18 |
| JP | 57-117080 | A | 7/1982 | G07D 3/16 |
| JP | 59-079392 | A | 5/1984 | G07D 3/16 |
| JP | 60-016271 | U | 2/1985 | G07F 7/02 |
| JP | 62-134168 | U | 8/1987 | G07B 1/00 |
| JP | 62-182995 | A | 8/1987 | G07F 7/08 |
| JP | 62-221773 | A | 9/1987 | G06F 15/30 |
| JP | 62-166562 | U | 10/1987 | G07B 1/00 |
| JP | 64-035683 | A | 2/1989 | G07D 9/00 |
| JP | 64-042789 | A | 2/1989 | G07F 9/00 |
| JP | 64-067698 | A | 3/1989 | G07F 7/08 |
| JP | 01-118995 | A | 5/1989 | G07G 1/00 |
| JP | 01-307891 | A | 12/1989 | G07D 9/00 |
| JP | 02-050793 | A | 2/1990 | G07D 9/00 |
| JP | 02-252096 | A | 10/1990 | G07D 9/00 |
| JP | 03-012776 | A | 1/1991 | G06F 15/30 |
| JP | 03-063795 | A | 3/1991 | G07D 3/00 |
| JP | 03-092994 | A | 4/1991 | G07D 9/00 |
| JP | 03-156673 | A | 7/1991 | G06F 15/30 |
| JP | 04-085695 | A | 3/1992 | G07F 11/72 |
| JP | 04-175993 | A | 6/1992 | G07F 5/22 |
| JP | 05-046839 | A | 2/1993 | G07D 5/02 |
| JP | 05-217048 | A | 8/1993 | G07D 3/16 |
| JP | 05-274527 | A | 10/1993 | G07D 9/00 |
| JP | 06-035946 | A | 2/1994 | G06F 15/30 |
| JP | 06-103285 | A | 4/1994 | G06F 15/21 |
| JP | 09-251566 | A | 9/1997 | G07F 7/08 |
| JP | 2002-117439 | A | 4/2002 | G07D 9/00 |
| JP | 2003-242287 | A | 8/2003 | G06F 17/60 |
| JP | 2004-213188 | A | 7/2004 | G06F 17/60 |
| SE | 44 244 | | 9/1988 | |
| WO | WO 85/00909 | A1 | 2/1985 | G07D 5/02 |
| WO | WO 91/06927 | A1 | 5/1991 | G07D 3/16 |
| WO | WO 91/08952 | A1 | 6/1991 | B65B 11/04 |
| WO | WO 91/12594 | A1 | 8/1991 | G07D 3/16 |
| WO | WO 91/18371 | A1 | 11/1991 | G07D 3/16 |
| WO | WO 92/08212 | A1 | 5/1992 | G07D 3/16 |
| WO | WO 92/20043 | A1 | 11/1992 | G07D 3/00 |
| WO | WO 92/20044 | A1 | 11/1992 | G07D 3/16 |
| WO | WO 92/22044 | A1 | 12/1992 | G07D 3/00 |
| WO | WO 93/00660 | A1 | 1/1993 | G07D 3/00 |
| WO | WO 93/09621 | A1 | 5/1993 | H04L 9/32 |

(56) References Cited

FOREIGN PATENT DOCUMENTS

| | | | | |
|---|---|---|---|---|
| WO | WO 94/06101 | A1 | 3/1994 | G07D 3/16 |
| WO | WO 94/08319 | A1 | 4/1994 | G07D 3/16 |
| WO | WO 94/23397 | A1 | 10/1994 | G07D 3/00 |
| WO | WO 95/02226 | A1 | 1/1995 | G07D 3/00 |
| WO | WO 95/04978 | A1 | 2/1995 | G07D 3/06 |
| WO | WO 95/06920 | A1 | 3/1995 | G07D 3/16 |
| WO | WO 95/09406 | A1 | 4/1995 | G07D 3/16 |
| WO | WO 95/13596 | A1 | 5/1995 | G07D 3/14 |
| WO | WO 95/19017 | A1 | 7/1995 | G07D 1/00 |
| WO | WO 95/23387 | A1 | 8/1995 | G07D 3/16 |
| WO | WO 95/30215 | A1 | 11/1995 | G07F 17/42 |
| WO | WO 96/07163 | A1 | 3/1996 | G07D 3/06 |
| WO | WO 96/07990 | A1 | 3/1996 | G07D 3/16 |
| WO | WO 96/12253 | A1 | 4/1996 | G07D 3/00 |
| WO | WO 96/27525 | A1 | 9/1996 | B65B 11/02 |
| WO | WO 96/27859 | A1 | 9/1996 | G07D 5/08 |
| WO | WO 97/22919 | A1 | 6/1997 | G06F 7/08 |
| WO | WO 97/25692 | A1 | 7/1997 | G07D 3/06 |
| WO | WO 98/24041 | A1 | 6/1998 | G06F 17/60 |
| WO | WO 98/24067 | A1 | 6/1998 | G07D 3/14 |
| WO | WO 98/48383 | A2 | 10/1998 | G07D 1/00 |
| WO | WO 98/48384 | A2 | 10/1998 | G07D 1/00 |
| WO | WO 98/48385 | A2 | 10/1998 | G07D 1/00 |
| WO | WO 98/51082 | A1 | 11/1998 | H04N 7/18 |
| WO | WO 98/59323 | A1 | 12/1998 | G07D 3/00 |
| WO | WO 99/00776 | A1 | 1/1999 | G07F 9/06 |
| WO | WO 99/06937 | A1 | 2/1999 | G06F 19/00 |
| WO | WO 99/16027 | A2 | 4/1999 | G07F 7/02 |
| WO | WO 99/33030 | A1 | 7/1999 | G07D 3/00 |
| WO | WO 99/41695 | A1 | 8/1999 | G06K 5/00 |
| WO | WO 99/48057 | A1 | 9/1999 | G07D 3/06 |
| WO | WO 99/48058 | A1 | 9/1999 | G07D 3/06 |
| WO | WO 00/48911 | A1 | 8/2000 | B65B 67/12 |
| WO | WO 00/65546 | A1 | 11/2000 | G07F 1/04 |
| WO | WO 01/63565 | A2 | 8/2001 | G07D 9/00 |
| WO | WO 02/071343 | A1 | 9/2002 | G07D 3/00 |
| WO | WO 03/052700 | A2 | 6/2003 | |
| WO | WO 03/079300 | A1 | 9/2003 | G07D 7/00 |
| WO | WO 03/085610 | A1 | 10/2003 | G07D 9/06 |
| WO | WO 03/107280 | A2 | 12/2003 | |
| WO | WO 2004/044853 | A1 | 5/2004 | G07D 3/12 |
| WO | WO 2004/109464 | A2 | 12/2004 | |
| WO | WO 2005/041134 | A2 | 5/2005 | |
| WO | WO 2005/088563 | A1 | 9/2005 | G07D 3/00 |
| WO | WO 2006/086531 | A1 | 8/2006 | G07D 9/00 |
| WO | WO 2007/035420 | A2 | 3/2007 | G06F 7/00 |
| WO | WO 2007/120825 | A2 | 10/2007 | G06K 9/00 |

OTHER PUBLICATIONS

AUI: Coinverter—"No More Lines . . . Self-Serve Cash-Out," by Cassius Elston, 1995 World Games Congress/Exposition Converter, 1 page (dated prior to 1995).
Brandt: 95 Series Coin Sorter Counter, 2 pages (1982).
Brandt: Model 817 Automated Coin and Currency Ordering System, 2 pages (1983).
Brandt: Model 920/925 Counter, 2 pages (date unknown, prior to Jul. 2011, possibly prior to Mar. 17, 1997).
Brandt: System 930 Electric Counter/Sorter, "Solving Problems, Pleasing Customer, Building Deposits," 1 page (date unknown, prior to Mar. 2, 2011, possibly prior to Mar. 17, 1997).
Brandt: Model 940-6 High Speed Sorter/Counter, 2 pages (date unknown, prior to Oct. 31, 1989).
Brandt: System 945 High-Speed Sorter, 2 pages (date unknown, prior to Mar. 2, 2011, possibly prior to Mar. 17, 1997).
Brandt: Model 952 Coin Sorter/Counter, 2 pages (date unknown, prior to Oct. 31, 1989).
Brandt: Model 954 Coin Sorter/Counter, 2 pages (date unknown, prior to Oct. 31, 1989).
Brandt: Model 957 Coin Sorter/Counter, 2 pages (date unknown, prior to Oct. 31, 1989).
Brandt: Model 958 Coin Sorter/Counter, 5 pages (© 1982).
Brandt: Model 960 High-Speed Coin Sorter & Counter, 2 pages (1984).
Brandt; Model 966 Microsoft™ Coin Sorter and Counter, 4 pages, (1979).
Brandt: Model 970 Coin Sorter and Counter, 2 pages (1983).
Brandt: Model 1205 Coin Sorter Counter, 2 pages (1986).
Brandt: Model 1400 Coin Sorter Counter, 2 pages (date unknown, prior to Mar. 2, 2011, possibly prior to Mar. 17, 1997).
Brandt: Model 8904 Upfeed—"High Speed 4-Denomination Currency Dispenser," 2 pages (1989).
Brandt: Mach 7 High-Speed Coin Sorter/Counter, 2 pages (1992).
Case ICC Limited: CDS Automated Receipt Giving Cash Deposit System, 3 pages (date unknown, prior to Nov. 15, 2000).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ,"3 pages (1981).
CTcoin: CDS602 Cash Deposit System, 1 page (date unknown, prior to Jan. 15, 2001).
Cummins: Cash Information and Settlement Systems (Form 023-1408), 4 pages (date Dec. 1991).
Cununins: The Universal Solution to All Coin and Currency Processing Needs (Form 13C1218 3-83), 1 page (Mar. 1983).
Cummins: JetSort® High Speed Sorter/Counter Kits I & J—Operating Instructions (Form 022-7123-00) 12 pages (1994).
Cummins: JetSort® Coin Sorter Counter/CA-130XL Coin Wrapper, Cummins Automated Money Systems (AMS) Case Study—Fifth-Third, "6,000 Coin Per Minute Counter/Sorter Keeps pace With Fifth-Third Bank's Money Processing Needs," (Form 13C1180), 2 pages (Nov. 1981).
Cummins: JetSort®, "Venders Love JetSort," (13C1255), 1 page (Mar. 1987).
Cummins: JetSort® "High Speed Coin Sorter & Counter for Payphone Applications," "CTOCS Ready" (Form 023-1365), 2 pages (Mar. 1989).
Cununins: JetSort® mailer, "One moving part simplicity," "Vendors—Are validators changing your coin and currency needs?" (Form 023-1297), 3 pages (Apr. 1987).
Cummins: JetSort® Series V High Speed Coin Sorter/Counter, (Form 023-1383), 2 pages (Sep. 1990).
Cummins: JetSort® "Time for a Change, Be a smashing success!," (Form 023-1328), 1 page (Jun. 1988).
Cummins: JetSort® "Time for a Change—JetSort® vs. Brandt X," (Form 023-1330), 1 page (Jun. 1988).
Cummins: JetSort® "Time for a Change—No Coins Sorted After 3:00 or on Saturday," (Form 023-1327), 1 page (Aug. 1988).
Cununins: JetSort®, "What do all these Banks have in Common . . . ?", JetSort, CA-130XL coin wrapper, CA-118 coin wrapper, CA-4000 JetCount, (13C1203), 3 pages (Aug. 1982).
Cummins: JetSort® 700-01/CA-118 Coin Wrapper, Cummins Automated Money Systems (AMS) Case Study—University State Bank, "Cummins Money Processing System Boosts Teller Service at University State Bank," (Form 13C1192), 2 pages (Mar. 1982).
Cummins: JetSort® 700-01, Cummins Automated Money Systems (AMS) Case Study—First State Bank of Oregon, "JetSort® Gives Bank Coin Service Edge," (Form 13C1196), 2 pages (Apr. 1982).
Cununins: JetSort® 700-01 Coin Sorter/Counter, Operating Instructions, 14 pages (1982).
Cummins: JetSort® 701, Cummins Automated Money Systems (AMS) Case Study—Convenco Vending, "High Speed Coin Sorter increases coin processing power at Convenco Vending," (Form 13C1226), 2 pages (Jul. 1983).
Cummins: JetSort Models 701 and 750 ,"State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).

(56) References Cited

OTHER PUBLICATIONS

Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 86).
Cummins: JetSort® 2000 Series High Speed Coin Sorter/Counter (Form 023-1488), 2 pages (Oct. 2000).
Cummins: JetSort®3000 Series High Speed Coin Sorter (Form 023-1468 Rev 1), 2 pages. (Feb. 1995).
Cummins: JetSort®3000 Series Options, "Talking JetSort 3000," (Form 023-1338-00), 1 pages (between Jan. 1989-Feb. 1989).
Cummins: JetSort®3000, "3,000 Coins per Minute!," (Form 023-1312), 1 page (date unknown, est. 1987).
Cununins: JetSort®3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS—Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, in Less Space Than a Branch Manager's Desk, 4 pages (date unknown, prior to Jan. 15, 2001).
Intellectual Australia Pty. Ltd.: Microbank, "From down under: Microbank," "hand-held smart card terminal that combines smart card functions and telephone banking," 2 pages (Feb. 1996).
ISH Electronic: ISH I2005/500 Coin Counter (with translation), 4 pages (date unknown, prior to Aug. 1996).
ISH Electronic: ISH I2005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deposit Systems, 1 page (date unknown, prior to Apr. 2003).
Reis Eumsystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Ganite Montreal, 2 pages(Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System—Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Canis," American Banker, New York, NY, vol. 159, Iss. 195, p. 37, 2 pages (Oct. 10, 1994).
Scan Coin: Coin Sachet System brochure, 4 pages (last page marked "© SCAN COIN / Jun. 2007").

* cited by examiner

SYSTEMS, METHODS AND DEVICES FOR MANAGING REJECTED COINS DURING COIN PROCESSING

CROSS-REFERENCE AND CLAIM OF PRIORITY TO RELATED APPLICATIONS

This application is a Continuation of U.S. patent application Ser. No. 14/818,734, which was filed on Aug. 5, 2015, now allowed, which claims the benefit of priority to U.S. Provisional Patent Application No. 62/033,936, which was filed on Aug. 6, 2014, and both of which are incorporated herein by reference in their respective entireties.

TECHNICAL FIELD

The present disclosure relates generally to systems, methods, and devices for processing currency. More particularly, aspects of this disclosure relate to methods for managing rejected coins during high-speed batch coin processing.

BACKGROUND

Some businesses, particularly banks, are regularly faced with large amounts of currency which must be organized, counted, authenticated and recorded. To hand count and record large amounts of currency of mixed denominations requires diligent care and effort, and demands significant manpower and time that might otherwise be available for more profitable and less tedious activity. To make counting of bills and coins less laborious, machines have been developed which automatically sort, by denomination, mixed assortments of currency, and transfer the processed currency into receptacles specific to the corresponding denominations. For example, coin processing machines for processing large quantities of coins from either the public at large or private institutions, such as banks, casinos, supermarkets, and cash-in-transit (CIT) companies, have the ability to receive bulk coins from users of the machine, count and sort the coins, and store the received coins in one or more coin receptacles, such as coin bins or coin bags. One type of currency processing machine is a redemption-type processing machine wherein, after the deposited coins and/or bank notes are counted, funds are returned to the user in a pre-selected manner, such as a payment ticket or voucher, a smartcard, a cash card, a gift card, and the like. Another variation is the deposit-type processing machine where funds which have been deposited by the user are credited to a personal account. Hybrid variations of these machines are also known and available.

A well-known device for processing coins is the disk-type coin sorter. In one exemplary configuration, the coin sorter, which is designed to process a batch of mixed coins by denomination, includes a rotatable disk that is driven by an electric motor. The lower surface of a stationary, annular sorting head is parallel to and spaced slightly from the upper surface of the rotatable disk. The mixed batch of coins is progressively deposited onto the top surface of the rotatable disk. As the disk is rotated, the coins deposited on the top surface thereof tend to slide outwardly due to centrifugal force. As the coins move outwardly, those coins which are lying flat on the top surface of the rotatable disk enter a gap between the disk and the sorting head. The lower surface of the sorting head is formed with an array of exit channels which guide coins of different denominations to different exit locations around the periphery of the disk. The exiting coins, having been sorted by denomination for separate storage, are counted by sensors packed along the exit channel. A representative disk-type coin sorting mechanism is disclosed in U.S. Pat. No. 5,009,627, to James M. Rasmussen, which is incorporated herein by reference in its entirety and for all purposes.

It is oftentimes desirable in the sorting of coins to discriminate between valid coins and invalid coins. Use of the term "valid coin" can refer to genuine coins of the type to be sorted. Conversely, use of the term "invalid coin" can refer to items in the coin processing unit that are not one of the coins to be sorted. For example, it is common that foreign (or "stranger") coins and counterfeit coins enter a coin processing system for sorting domestic coin currency. So that such items are not sorted and counted as valid coins, it is helpful to detect and discard these "invalid coins" from the coin processing system. In another application wherein it is desired to process only U.S. quarters, nickels and dimes, all other U.S. coins, including dollar coins, half-dollar coins, pennies, etc., are considered "invalid." Additionally, coins from all other coins sets including Canadian coins and European coins, for example, would be considered "invalid" when processing U.S. coins. In another application it may be desirable to separate coins of one country (e.g., Canadian coins) from coins of another country (e.g., U.S. coins). Finally, any truly counterfeit coins (also referred to in the art as "slugs") are always considered "invalid" regardless of application.

SUMMARY

With the continued development of coin processing machines and the increased understanding of the markets and customers for which these products are targeted, new challenges associated with the management of erroneously rejected coins have been identified. Coins can be mistakenly rejected or otherwise mischaracterized during processing for any of an assortment of reasons, whereby genuine coins are deemed to be "strangers" or "counterfeit," genuine coins are rejected as "unfit," or stranger coins and counterfeit coins are mischaracterized as "genuine," for example. Recent developments in coin discrimination technology have reached a level of precision that is reliable for separating known counterfeit coins from genuine coins and for separating coins from non-target countries ("strangers") from genuine coins from a target country. However, the quality of counterfeits continues to increase, resulting in a higher likelihood of coin mischaracterization. For instance, if the metallurgical characteristics and/or other security features in a counterfeit coin substantially coincide with those of genuine coins, there is an increased likelihood the counterfeit coin will be characterized as valid. In the same vein, coins from non-target countries oftentimes have similar structural properties, metallurgical properties and/or other security features to those from target countries (at least those properties for which detection is enabled), which can once again result in the inadvertent crossover of stranger coins with genuine valid coins from the target country.

One manner of minimizing the acceptance of counterfeit coins and stranger coins is to increase the sensitivity of the coin detection system. This increased sensitivity, however, can increase the potential of rejecting genuine coins due to conditions such as, for example, mint process variations and fit verses unfit characteristics. Another manner of minimizing the acceptance of counterfeit coins and stranger coins is to change the parameters of the coin detection system. The alternate parameters, however, can increase the potential for rejecting genuine coins due to conditions; for example, mint process variations and fit versus unfit characteristics.

One design goal when developing new coin processing systems is to achieve a zero percent false reject rate of genuine coins that are fit for circulation (e.g., any coin that does not exhibit significant damage or wear). As a contingency position, it is deemed acceptable in some applications to have a "reasonable" false reject rate of valid coins (e.g., less than or equal to 1%) during a first pass when genuine and fit coins are accepted on a second pass. Other applications may demand a threshold acceptable false reject rate during each pass of coin analysis in order to achieve a zero or near zero percent false reject rate. One optional design goal is to confirm authenticity of all genuine fit and unfit coins, and add those coins to the batch total for credit, while continuing to properly reject stranger and counterfeit coins.

Another potential challenge when developing new coin processing systems is how to provide customers credit for rejected valid coins (e.g., genuine fit and unit) while managing counterfeit and stranger activity during processing. For instance, one coin processing machine may do a very good job of separating counterfeit coins; however, this is at the expense of rejecting inordinate quantities of genuine fit coins. This machine may evaluate all rejects, for example, up to as many as three times and, after the third attempt, any remaining coins that are rejected are confiscated and the customer is debited their value. Customers will eventually become upset at the increase in charge backs due to genuine fit coins that were erroneously characterized as counterfeit, stranger and/or unfit. To keep customers happy, the equipment manufacturer may desensitize or sensitize the coin processing machine, and/or modify acceptance criteria or change detection parameters of the coin processing machine in an attempt to reduce false rejects of genuine target coins. In markets with significant counterfeiting activity, however, this will likely result in a higher false acceptance rate of counterfeit coins and/or unfit genuine coins being characterized as fit and genuine. It is generally desirable, for at least some embodiments, to provide credit to users for unfit genuine coins and otherwise machine unreadable genuine coins, while at the same time removing them from circulation.

Currency processing systems, coin processing machines, coin processing units, and methods of managing rejected coins during coin processing are presented herein. Aspects of the present disclosure are directed to systems, methods and devices for providing credit to customers for rejected valid coins in their deposits while managing counterfeit and stranger activity. Aspects of the present disclosure are directed to systems, methods and devices for providing credit to customers for unfit genuine coins in their deposits while removing these coins from circulation. Also disclosed are automated processes for managing rejected genuine coins, both fit and unfit, without compromising the precision and sensitivity needed to reject counterfeit and stranger coins. Other aspects are directed to managing rejected coins with a dedicated auxiliary authentication device applied to a coin processing unit. Additional aspects are directed to systems, methods and devices for separating out reject coins within the machine, holding the reject coins in a dedicated reject location within the machine, and then reintroducing the reject coins back into the coin machine and subjecting them to alternative detection parameters, sensitivities, or other technologies as a post process within a batch. In another embodiment, a coin processing system, upon identification of a rejected coin, automatically reintroduces that coin into the hopper area, concomitantly changes the system's sensing characteristics, runs the processing unit at a reduced speed until there is certainty that the rejected coin was processed through the unit, and then resumes normal operating speed. During this time, the sensing characteristics can be modified in such a way that would provide additional scrutiny of the rejected coin being processed. It is also envisioned that any of the features disclosed herein could be similarly applied, singly and in any combination, to processing of paper currency.

Aspects of the present disclosure are directed to a method for managing coins processed by a currency processing system. The method includes: receiving a batch of coins via a coin input area of the currency processing system; feeding the batch of coins into a coin processing unit of the currency processing system, the coin processing unit including one or more coin discriminating sensors; sorting the batch of coins into genuine fit target coins (e.g., valid coins) and reject coins (e.g., invalid coins) with the coin processing unit; sorting the reject coins into a plurality of reject groups, each of which corresponds to a respective category of rejected coins; analyzing at least one of the reject groups to determine if any genuine target coins were mischaracterized and erroneously sorted into that reject group; and, crediting the user (e.g., a user account) of the currency processing system for any genuine target coins in the at least one reject group determined to have been mischaracterized and erroneously sorted.

For some embodiments, sorting the coin batch into genuine fit target coins and reject coins is performed with the currency processing system set in a first mode of operation, which includes an increased sensitivity level of one or more of the coin discriminating sensors in the coin processing unit. Optionally or alternatively, the first mode of operation may comprise changing coin sensing parameters. For some embodiments, sorting the reject coins into the reject groups is performed with the currency processing system set in a second mode of operation, which includes a decreased sensitivity level of one or more of the coin discriminating sensors in the coin processing unit. For some embodiments, the reject groups includes a first reject group comprising stranger and counterfeit coins, a second reject group comprising rejected coins appearing to be genuine and fit, and a third reject group comprising genuine coins exhibiting unfit characteristics. A fourth coin group may comprise genuine fit target coins. The designated reject groups may comprise greater or fewer than four coin groups. For example, an optional reject group can consist of just counterfeit coins. For some embodiments, the user of the currency processing system is credited for all genuine target coins, both fit and unfit, in the reject group(s). It is also envisioned that the user could be credited for stranger coins or, under certain circumstances, counterfeit coins.

Other aspects of the present disclosure are directed to non-transitory computer-readable storage media storing instructions which, when executed by one or more processors of a currency processing system, cause the one or more processors to perform certain operations. These operations include: receiving a signal to begin processing a batch of coins received via a coin input area of the currency processing system, the currency processing system including a coin processing unit with one or more coin discriminating sensors or sensor systems; directing the coin processing unit to sort the batch of coins into genuine fit target coins (e.g., valid coins) and reject coins (e.g., invalid coins); directing the coin processing unit to sort the reject coins into a plurality of reject groups, each of which corresponds to a respective category of rejected coins (e.g., which may include one or more user defined coin groups); receiving signals from the one or more coin discriminating sensors indicative of coin parameters of the reject coins in at least one of the reject groups; determine if any genuine target coins were mischaracterized and erroneously sorted into the at least one reject group; and, crediting a user of the currency processing system for the genuine target coins in that reject group which were determined to have been mischaracterized and erroneously sorted.

According to other aspects of the present disclosure, a currency processing system for processing and sorting coins is presented. The currency processing system includes a coin input area configured to receive coins, and coin receptacles configured to receive and stow processed coins. A coin processing unit, which includes one or more coin discriminating sensors, is configured to receive coins from the coin input area, process the coins, and output the processed coins to the coin receptacles. The currency processing system also includes one or more processors and one or more memory devices that store instructions which, when executed by at least one of the processors, cause the processor(s) to perform certain operations. These operations include: receiving a signal indicative of a batch of coins being received via the coin input area; receiving a signal indicative of the batch of coins being fed into the coin processing unit; directing the coin processing unit to sort the batch of coins into genuine fit target coins and reject coins; directing the coin processing unit to sort the reject coins into a plurality of reject groups, each of which corresponds to a respective category of rejected coins; receiving signals from the one or more coin discriminating sensors indicative of coin parameters of the reject coins in at least one of the reject groups; determine if any genuine target coins were mischaracterized and erroneously sorted into the at least one reject group; and crediting a user of the currency processing system for the genuine target coins in the at least one reject group which were determined to have been mischaracterized and erroneously sorted.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the representative embodiments and modes for carrying out the present invention when taken in connection with the accompanying drawings and appended claims.

Figure 1:
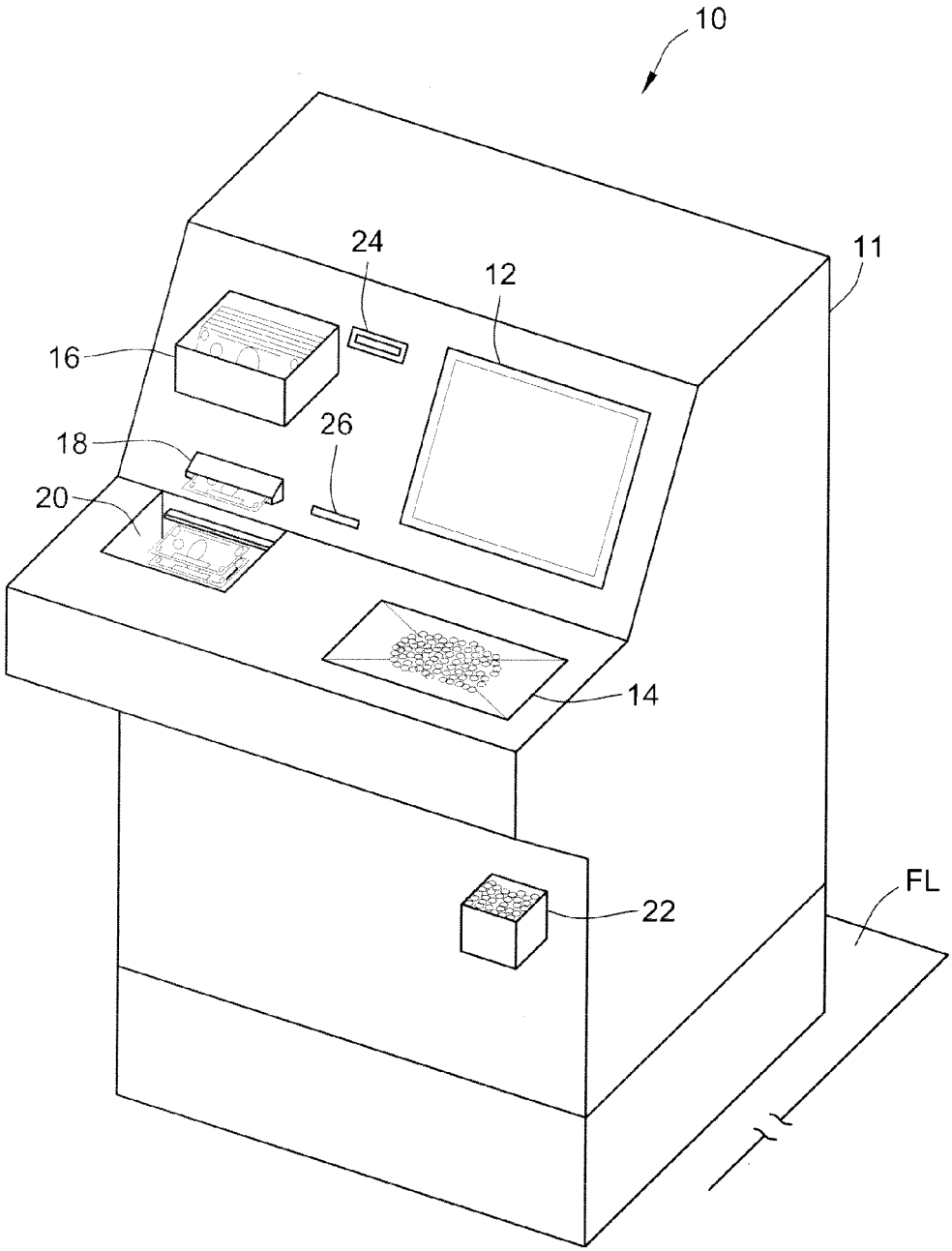
FIG. 1 is a front perspective-view illustration of an example of a currency processing system in accordance with aspects of the present disclosure.

The present disclosure is susceptible to various modifications and alternative forms, and some representative embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

This invention is susceptible of embodiment in many different forms. There are shown in the drawings, and will herein be described in detail, representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an example of a currency processing system, designated generally as 10, in accordance with aspects of the present disclosure. Many of the disclosed concepts are discussed with reference to the representative currency processing systems depicted in the drawings. However, the novel aspects and features of the present disclosure are not per se limited to the particular arrangements and components presented in the drawings. For example, many of the features and aspects presented herein can be applied to other currency processing systems without departing from the intended scope and spirit of the present disclosure. Examples of currency processing systems into which the disclosed concepts can be incorporated are the JETSORT® and JETSORT® LX families of coin sorting machines available from Cummins-Allison Corp. The inventive aspects of the present disclosure, however, are not limited to coins processing systems utilizing sorting disks and could be utilized in other currency processing systems, including machines for processing paper currency. In addition, although differing in appearance, the coin processing systems and devices depicted and discussed herein can each take on any of the various forms, optional configurations, and functional alternatives described above and below with respect to the other disclosed embodiments, and thus can include any of the corresponding options and features. It should also be understood that the drawings are not necessarily to scale and are provided purely for descriptive purposes; thus, the individual and relative dimensions and orientations presented in the drawings are not to be considered limiting.

The currency processing system 10 is a hybrid redemption-type and deposit-type currency processing machine with which funds may be deposited into and returned from the machine, in similar or different forms, in whole or in part, and/or funds may be credited to and withdrawn from a personal account. The currency processing machine 10 illustrated in FIG. 1 includes a housing 11 that may house various input devices, output devices, and input/output devices. By way of non-limiting example, the currency processing machine 10 includes a display device 12 that may provide various input and output functions, such as displaying information and instructions to a user and receiving selections, requests, and other forms of inputs from a user. The display device 12 is, in various embodiments, a cathode ray tube (CRT), a high-resolution liquid crystal display (LCD), a plasma display, a light emitting diode (LED) display, a DLP projection display, an electroluminescent (EL) panel, or any other type of display suitable for use in the currency processing machine 10. A touch screen, which has one or more user-selectable soft touch keys, may be mounted over the display device 12. While a display device 12 with a touchscreen may be a preferred means for a user to enter data, the currency processing machine 10 may include other known input devices, such as a keyboard, mouse, joystick, microphone, etc.

The currency processing machine 10 includes a coin input area 14, such as a bin or tray, which receives batches of coins from a user. Each coin batch may be of a single denomination, a mixed denomination, a local currency, or a foreign currency, or any combination thereof. Additionally, a bank note input area 16, which may be in the nature of a retractable pocket or basket, is also offered by the currency processing machine 10. The bank note input area 16, which is illustrated in its open position in FIG. 1, can be retracted by the currency processing machine 10 once the bulk currency has been placed therein by the user. In addition to banknotes, or as a possible alternative, the bank note receptacle 16 of the currency processing machine 10 can also be operable to accommodate casino scrip, paper tokens, bar coded tickets, or other known forms of value. These input devices—i.e., the currency input areas 14 and 16, allow the user of the currency processing machine 10 to input his or her funds, which can ultimately be converted to some other sort of fund source that is available to the user. Optionally or alternatively, the currency processing machine 10 can operate to count, authenticate, valuate, and/or package funds deposited by a user.

In addition to the above-noted output devices, the currency processing machine 10 may include various output devices, such as a bank note dispensing receptacle 20 and a coin dispensing receptacle 22 for dispensing to the user a desired amount of funds in bank notes, coins, or a combination thereof. An optional bank note return slot 18 may also be included with the currency processing machine 10 to return notes to the user, such as those which are deemed to be counterfeit or otherwise cannot be authenticated or processed. Coins which cannot be authenticated or otherwise processed may be returned to the user via the coin dispensing receptacle 22. The currency processing machine 10 further includes a paper dispensing slot 26, which can be operable for providing a user with a receipt of the transaction that was performed.

In one representative transaction, the currency processing machine 10 receives funds from a user via the coin input area 14 and/or the bank note input area 16 and, after these deposited funds have been authenticated and counted, the currency processing machine 10 returns to the user an amount equal to the deposited funds but in a different variation of bank notes and coins. Optionally, the user may be assessed one or more fees for the transaction (e.g., service fees, transaction fees, etc.). For example, the user of the currency processing machine 10 may input $102.99 in various small bank notes and pennies and in turn receive a $100 bank note, two $1 bank notes, three quarters, two dimes, and four pennies. As another option or alternative, the currency processing machine 10 may simply output a voucher or a receipt of the transaction through the paper dispensing slot 26 which the user can then redeem for funds by an attendant of the currency processing machine 10. Yet another option or alternative would be for the currency processing machine 10 to credit some or all of the funds to a personal account, such as a bank account or store account. As yet another option, the currency processing machine 10 may credit some or all of the funds to a smartcard, gift card, cash card, virtual currency, etc.

The currency processing machine 10 may also include a media reader slot 24 into which the user inserts a portable medium or form of identification, such as a driver's license, credit card, or bank card, so that the currency processing machine 10 can, for example, identify the user and/or an account associated with the user. The media reader 24 may take on various forms, such as a ticket reader, card reader, bar code scanner, wireless transceiver (e.g., RFID, Bluetooth, etc.), or computer-readable-storage-medium interface. The display device 12 with a touchscreen typically provides the user with a menu of options which prompts the user to carry out a series of actions for identifying the user by displaying certain commands and requesting that the user press touch keys on the touch screen (e.g. a user PIN). The media reader device 24 of the illustrated example is configured to read from and write to one or more types of media. This media may include various types of memory storage technology such as magnetic storage, solid state memory devices, and optical devices. It should be understood that numerous other peripheral devices and other elements exist and are readily utilizable in any number of combinations to create various forms of a currency processing machine in accord with the present concepts.

Figure 2:
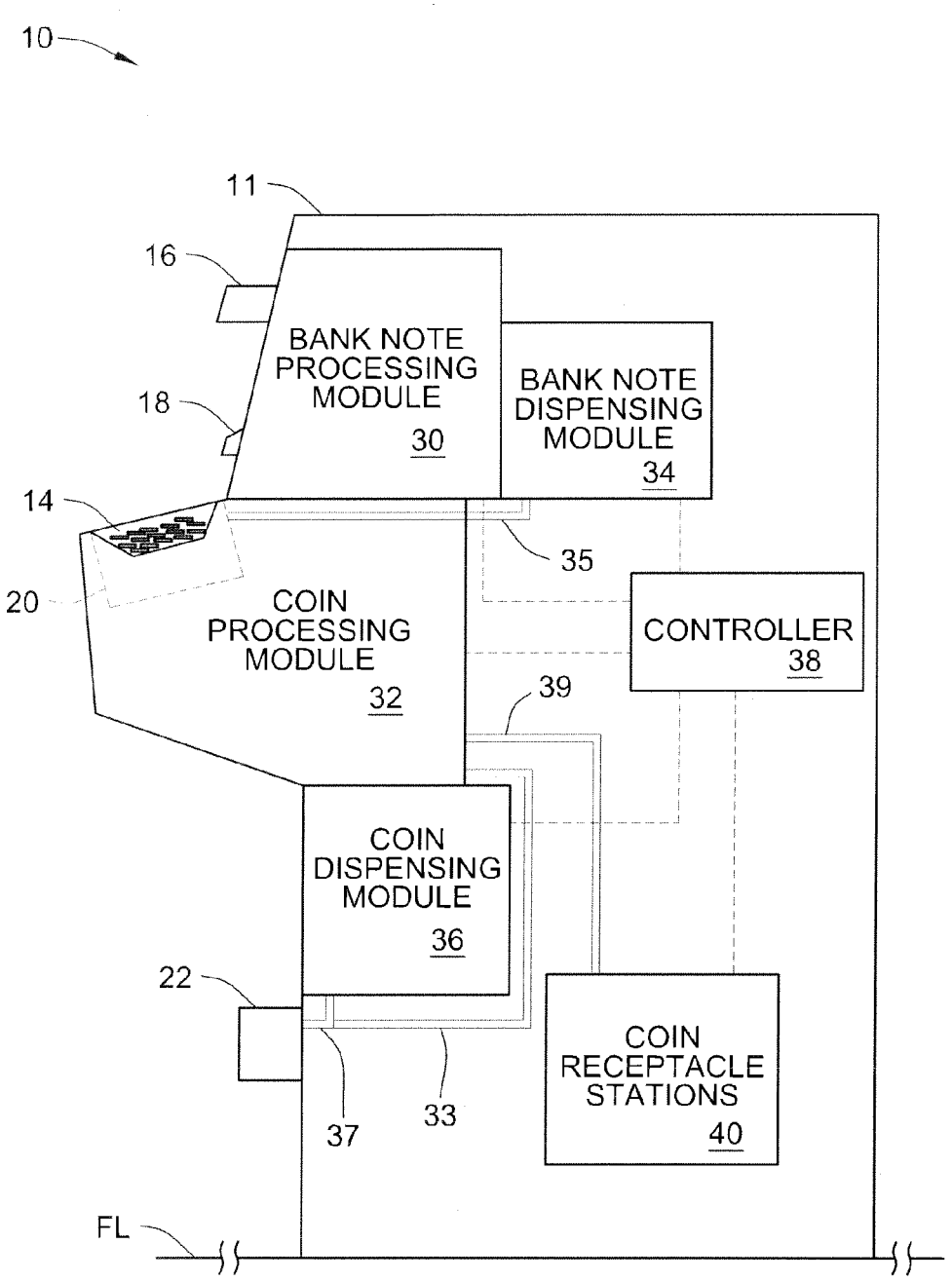
FIG. 2 is a schematic side-view illustration of the representative currency processing machine of FIG. 1.

FIG. 2 is a schematic illustration of the currency processing machine 10 showing various modules which may be provided in accord with the disclosed concepts. A bank note processing module 30, for example, receives bank notes from the bank note input area 16 for processing. In accord with a representative configuration, the inward movement of a retractable bank note input area 16 positions a stack of bills at a feed station of the bank note scanning and counting device which automatically feeds, counts, scans, authenticates, and/or sorts the bank notes, one at a time, at a high rate of speed (e.g., at least approximately 350 bills per minute). In place of, or in addition to the bank note input area 16, the currency processing machine 10 may include a single bank note receptacle for receiving and processing one bank note at a time. The bank notes that are recognized and/or deemed authentic by the bank note processing module 30 are delivered to a currency canister, cassette or other known storage container. When a bank note cannot be recognized by the bank note processing module 30, it can be returned to the customer through the bank note return slot 18. Exemplary machines which scan, sort, count, and authenticate bills as may be required by the bank note processing module 30 are described in U.S. Pat. Nos. 5,295,196, 5,970,497, 5,875,259, which are incorporated herein by reference in their respective entireties and for all purposes.

The representative currency processing machine 10 shown in FIG. 2 also includes a coin processing module 32. The coin processing module 32 may be operable to sort, count, valuate and/or authenticate coins which are deposited in the coin input receptacle 14, which is operatively connected to the coin processing module 32. The coins can be sorted by the coin processing module 32 in a variety of ways, but one known method is sorting based on the diameters of the coins. When a coin cannot be authenticated or counted by the coin processing module 32, it can be directed back to the user through a coin reject tube 33 which leads to the coin dispensing receptacle 22. Thus, a user who has entered such a non-authenticated coin can retrieve the coin by accessing the coin dispensing receptacle 22. Examples of coin sorting and authenticating devices which can perform the function of the coin processing module 32 are disclosed in U.S. Pat. Nos. 5,299,977, 5,453,047, 5,507,379, 5,542,880, 5,865,673, 5,997,395, which are incorporated herein by reference in their respective entireties and for all purposes.

The currency processing machine 10 further includes a bank note dispensing module 34 which is connected via a transport mechanism 35 to the user-accessible bank note dispensing receptacle 20. The bank note dispensing module 34 typically dispenses loose bills in response to a request of the user for such bank notes. Also, the bank note dispensing module 34 may be configured to dispense strapped notes into the bank note dispensing receptacle 20 if that is desired. In one embodiment of the present disclosure, the user may select the denominations of the loose/strapped bills dispensed into the bank note dispensing receptacle 20.

The currency processing machine 10 also includes a coin dispensing module 36 which dispenses loose coins to the user via the coin dispensing receptacle 22. The coin dispensing module 36 is connected to the coin dispensing receptacle 22, for example, via a coin tube 37. With this configuration, a user of the currency processing machine 10 has the ability to select the desired coin denominations that he or she will receive during a transaction, for example, in response to user inputs received by one or more of the available input devices. Also, the coin dispensing module 36 may be configured to dispense packaged (e.g., sachet or rolled) coins into the coin dispensing receptacle 22 if that is desired. The coins which have been sorted into their respective denominations by the coin processing module 32 are discharged into one or more coin chutes or tubes 39 which direct coins to a coin receptacle station(s) 40. In at least some aspects, a plurality of tubes 39 are provided and advantageously are positioned to direct coins of specified denominations to designated coin receptacles. The currency processing machine 10 may include more or fewer than the modules illustrated in FIG. 2, such as a coin packaging module or a note packaging module.

The currency processing machine 10 includes a controller 38 which is coupled to each module within the currency processing machine 10, and optionally to an external system, and controls the interaction between each module. For example, the controller 38 may review the input totals from the funds processing modules 30 and 32 and direct an appropriate funds output via the funds dispensing modules 34 and 36. The controller 38 also directs the operation of the coin receptacle station 40 as described below. While not shown, the controller 38 is also coupled to the other peripheral components of the currency processing machine 10, such as a media reader associated with the media reader slot 24 and also to a printer at the receipt dispenser 26, if these devices are present on the coin processing mechanism 10. The controller 38 may be in the nature of a central processing unit (CPU) connected to a memory device. The controller 38 may include any suitable processor, processors and/or microprocessors, including master processors, slave processors, and secondary or parallel processors. The controller 38 may comprise any suitable combination of hardware, software, or firmware disposed inside and/or outside of the housing 11.

Figure 3:
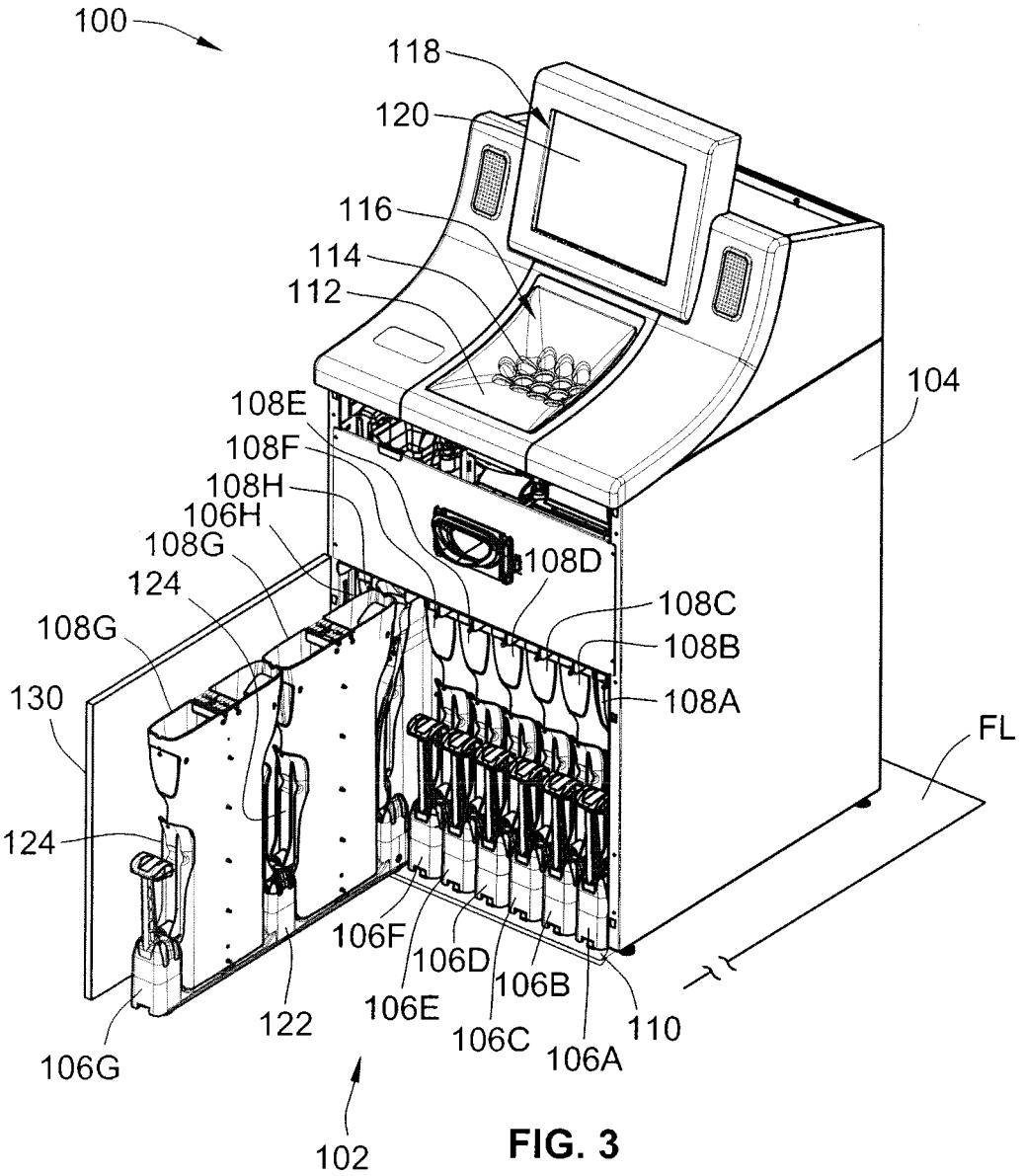
FIG. 3 is a front perspective-view illustration of an example of a coin processing machine in accordance with aspects of the present disclosure.

Another example of a currency processing system is illustrated in accordance with aspects of this disclosure in FIG. 3, this time represented by a coin processing machine 100. The coin processing machine 100 has a coin tray 112 that holds coins prior to and/or during inputting some or all of the coins in the coin tray 112 into the coin processing machine 100. The coin tray 112 may be configured to transfer coins deposited thereon, e.g., by pivoting upwards and/or by downwardly sloping coin surfaces, to a coin sorting mechanism (not visible in FIG. 3; may correspond to coin processing unit 200 of FIG. 4) disposed within a cabinet or housing 104. The coins are transferred from the coin tray 112 to the sorting mechanism, under the force of gravity, via a funnel arrangement 114 formed in a coin input area 116 of the cabinet 104. Once processed, the coin sorting mechanism discharges sorted coins to a plurality of coin bags or other coin receptacles that are housed within the cabinet (or "housing") 104.

A user interface 118 interacts with a controller (e.g., controller 38 of FIG. 2) of the coin processing machine 100. The controller is operable, in at least some embodiments, to control the initiation and termination of coin processing, to determine the coin totals during sorting, to validate the coins, and to calculate or otherwise determine pertinent data regarding the sorted coins. The user interface 118 of FIG. 3 includes a display device 120 for displaying information to an operator of the coin processing machine 100. Like the display device 12 illustrated in FIG. 1, the display device 120 of FIG. 3 may also be capable of receiving inputs from an operator of the coin processing machine 100, e.g., via a touchscreen interface. Inputs from an operator of the coin processing machine 100 can include selection of predefined modes of operation, instructions for defining modes of operation, requests for certain outputs to be displayed on the display device 120 and/or a printer (not shown), identification information, such as an identification code for identifying particular transactions or batches of coins, etc.

During an exemplary batch sorting operation, an operator dumps a batch of mixed coins into the coin tray 112 and inputs an identification number along with any requisite information via the interface 118. The operator (or the machine 100) then transfers some or all of the coins within the coin tray 112 to the sorting mechanism through the coin input area 116 of the cabinet 104. Coin processing may be initiated automatically by the machine 100 or in response to a user input. While the coins are being sorted, the operator can deposit the next batch of coins into the coin tray 112 and enter data corresponding to the next batch. The total value of each processed (e.g., sorted, denominated and authenticated) batch of coins can be redeemed, for example, via a printed receipt or any of the other means disclosed herein.

The coin processing machine 100 has a coin receptacle station 102 disposed within the housing 104. When the coin processing machine 100 is disposed in a retail setting or other publicly accessible environment, e.g., for use as a retail coin redemption machine, the coin receptacle station 102 can be secured inside housing 104, e.g., via a locking mechanism, to prevent unauthorized access to the processed coins. The coin receptacle station 102 includes a plurality of moveable coin-receptacle platforms 106A-H ("moveable platforms"), each of which has one or more respective coin receptacles 108A-H disposed thereon. Each moveable platform 106A-H is slidably attached to a base 110, which may be disposed on the ground beneath the coin processing machine 100, may be mounted to the coin processing machine 100 inside the housing 104, or a combination thereof. In the illustrated embodiment, the coin receptacle station 102 includes eight moveable coin-receptacle platforms 106A-H, each of which supports two coin receptacles 108A-H, such that the coin processing machine 100 accommodates as many as sixteen individual receptacles. Recognizably, the coin processing machine 100 may accommodate greater or fewer than sixteen receptacles that are supported on greater or fewer than eight coin-receptacle platforms.

The coin receptacles 108A-H of the illustrated coin receptacle station 102 are designed to accommodate coin bags. Alternative variations may be designed to accommodate coin cassettes, cashboxes, coin bins, etc. Alternatively still, the moveable platforms 106A-H may have more than one type of receptacle disposed thereon. In normal operation, each of the coin receptacles 108A-H acts as a sleeve that is placed inside of a coin bag to keep coins within a designated volume during filling of the coin bag. In effect, each coin receptacle 108A-H acts as an internal armature, providing an otherwise non-rigid coin bag with a generally rigid internal geometry. Each of the platforms 106A-H includes a coin bag partition 122 that separates adjacent coin bags from one another for preventing coin bags from contacting adjacent coin bags and disrupting the flow of coins into the coin bags. For other embodiments, each moveable platform 106A-H may include multiple partitions 122 to accommodate three or more coin receptacles 108A-H. The moveable platforms 106A-H also include bag clamping mechanisms 124 for each of the coin receptacles 108A-H. Each bag clamping mechanism 124 operatively positions the coin bag for receiving processed coins, and provides structural support to the coin receptacle 108A-H when the moveable platform 106A-H is moved in and out of the machine.

The number of moveable platforms 106A-H incorporated into the coin processing machine 100 can correspond to the number of coin denominations to be processed. For example, in the U.S. coin set: pennies can be directed to the first coin receptacles 108A disposed on the first moveable platform 106A, nickels can be directed to the second coin receptacles 108B disposed on the second moveable platform 106B, dimes can be directed to the third coin receptacles 108C disposed on the third moveable platform 106C, quarters can be directed to the fourth coin receptacles 108D disposed on the fourth moveable platform 106D, half-dollar coins can be directed to the fifth coin receptacles 108E disposed on the fifth moveable platform 106E, dollar coins can be directed to the sixth coin receptacles 108F disposed on the sixth moveable platform 106F. The seventh and/or eighth moveable platforms 106G, 106H can be configured to receive coin overflow, invalid coins, or other rejected coins. Optionally, coins can be routed to the coin receptacles 108A-H in any of a variety of different manners. For example, in the illustrated configuration, if the operator of the coin processing machine 100 is anticipating a larger number of quarters than the other coin denominations, three or more of the coin receptacles 108A-H on the moveable platforms 106A-H may be dedicated to receiving quarters. Alternatively, half-dollar coins and dollar coins, of which there are fewer in circulation and regular use than the other coin denominations, can each be routed to a single dedicated coin receptacle.

In operation, an operator of the coin processing machine 100 who desires to access one or more of the coin receptacles 108A-H unlocks and opens a front door 130 of the housing 104 to access the coin receptacle station 102. Depending on which coin receptacle(s) the operator needs to empty, for example, the operator slides or otherwise moves one of the moveable coin-receptacle platforms 106A-H from a first "stowed" position inside the housing 104 (e.g., moveable platform 106A in FIG. 3) to a second "extracted" position outside of the housing 104 (e.g., moveable platform 106G in FIG. 3). If any of the coin bags are filled and need to be replaced, the operator may remove filled coin bags from the extracted movable platform, replace the filled coin bags with empty coin bags, return the movable platform to the stowed position, and subsequently shut and lock the front door 130.

Figure 4:
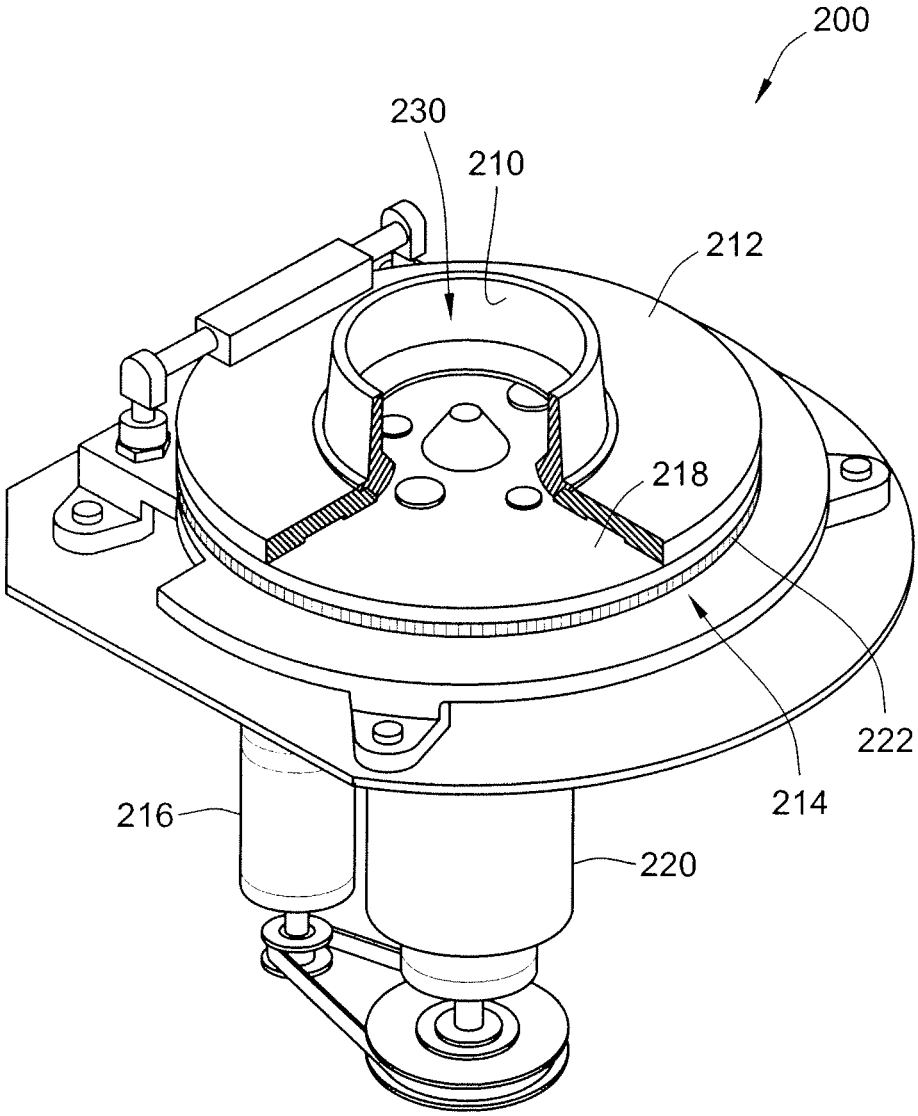
FIG. 4 is a partially broken away perspective-view illustration of an example of a disk-type coin processing unit in accordance with aspects of the present disclosure.

FIG. 4 shows a non-limiting example of a coin sorting device, represented herein by a disk-type coin processing unit 200 that can be used in any of the currency processing systems, methods and devices disclosed herein. The coin processing unit 200 includes a hopper channel, a portion of which is shown at 210, for receiving coins of mixed denominations from a coin input area (e.g., coin input areas 14 or 116 of FIGS. 1 and 3). The hopper channel 210 feeds the coins through a central opening 230 in an annular, stationary sorting head 212. As the coins pass through this opening, the coins are deposited onto the top surface of a resilient pad 218 disposed on a rotatable disk 214. According to some embodiments, coins are initially deposited by a user onto a coin tray (e.g., coin tray 112 of FIG. 3) disposed above the coin processing unit 200; coins flow from the coin tray into the hopper channel 210 under the force of gravity.

This rotatable disk 214 is mounted for rotation on a shaft (not visible) and driven by an electric motor 216. The rotation of the rotatable disk 214 of FIG. 4 is slowed and stopped by a braking mechanism 220. The disk 214 typically comprises a resilient pad 218, preferably made of a resilient rubber or polymeric material, that is bonded to, fastened on, or integrally formed with the top surface of a solid disk 222. The resilient pad 218 may be compressible such that coins laying on the top surface thereof are biased or otherwise pressed upwardly against the bottom surface of the sorting head 212 as the rotatable disk 214 rotates. The solid disk 222 is typically fabricated from metal, but it can also be made of other materials, such as a rigid polymeric material.

The underside of the inner periphery of the sorting head 212 is spaced above the pad 218 by a distance which is approximately the same as or, in some embodiments, just slightly less than the thickness of the thinnest coin. While the disk 214 rotates, coins deposited on the resilient pad 218 tend to slide outwardly over the top surface of the pad 218 due to centrifugal force. As the coins continue to move outwardly, those coins that are lying flat on the pad 218 enter a gap between the upper surface of the pad 218 and the lower surface of the sorting head 212. As is described in further detail below, the sorting head 212 includes a plurality of coin directing channels (also referred to herein as "exit channels") for manipulating the movement of the coins from an entry area to a plurality of exit stations (or "exit slot") where the coins are discharged from the coin processing unit 200. The coin directing channels may sort the coins into their respective denominations and discharge the coins from exit stations in the sorting head 212 corresponding to their denominations.

Figure 5:
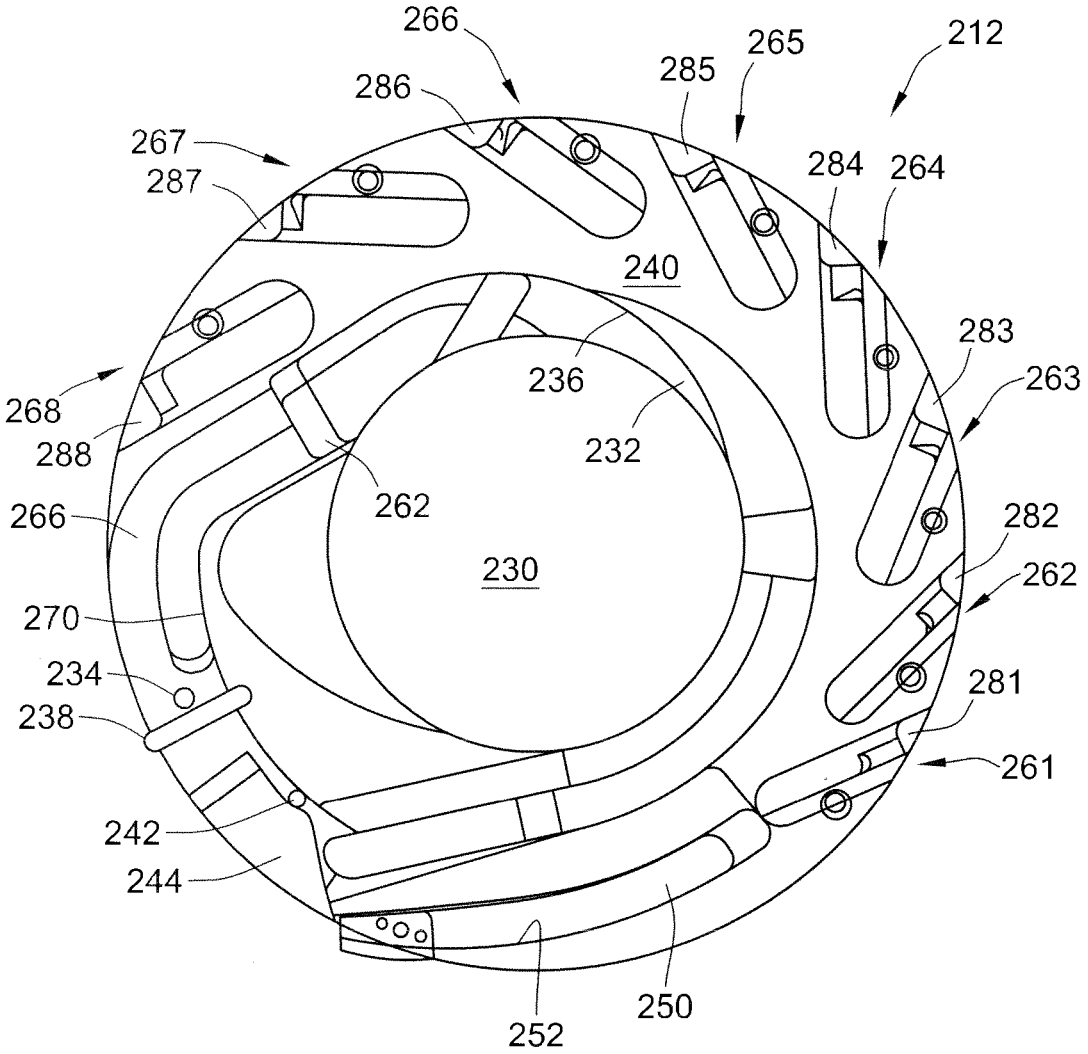
FIG. 5 is an enlarged bottom-view illustration of the sorting head of the exemplary disk-type coin processing unit of FIG. 4.

Referring now to FIG. 5, the underside of the sorting head 212 is shown. The coin set for a given country can be sorted by the sorting head 212 due to variations in the diameter and/or thickness of the individual coin denominations. For example, according to the United States Mint, the U.S. coin set has the following diameters:

Penny=0.750 in. (19.05 mm)
Nickel=0.835 in. (21.21 mm)
Dime=0.705 in. (17.91 mm)
Quarter=0.955 in. (24.26 mm)
Half Dollar=1.205 in. (30.61 mm)
Presidential One Dollar=1.043 in. (26.49 mm)

The coins circulate between the stationary sorting head 212 and the rotating pad 218 on the rotatable disk 214, as shown in FIG. 4. Coins that are deposited on the pad 218 via the central opening 230 initially enter an entry channel 232 formed in the underside of the sorting head 212. It should be kept in mind that the circulation of the coins in FIG. 5 appears counterclockwise as FIG. 5 is a view of the underside of the sorting head 212.

An outer wall 236 of the entry channel 232 divides the entry channel 232 from the lowermost surface 240 of the sorting head 212. The lowermost surface 240 is preferably spaced from the pad 218 by a distance that is slightly less than the thickness of the thinnest coins. Consequently, the initial outward radial movement of all the coins is terminated when the coins engage the outer wall 236, although the coins continue to move more circumferentially along the wall 236 (e.g., in a counterclockwise direction in FIG. 5) by the rotational movement imparted to the coins by the pad 218 of the rotatable disk 214.

While the pad 218 continues to rotate, those coins that were initially aligned along the wall 236 move across the ramp 262 leading to a queuing channel 266 for aligning the innermost edge of each coin along an inner queuing wall 270. The coins are gripped between the queuing channel 266 and the pad 218 as the coins are rotated through the queuing channel 266. The coins, which were initially aligned with the outer wall 236 of the entry channel 232 as the coins move across the ramp 262 and into the queuing channel 266, are rotated into engagement with inner queuing wall 270. As the pad 218 continues to rotate, the coins which are being positively driven by the pad move through the queuing channel 266 along the queuing wall 270 past a trigger sensor 234 and a discrimination sensor 238, which may be operable for discriminating between valid and invalid coins. In some embodiments, the discrimination sensor 238 may also be operable to determine the denomination of passing coins. The trigger sensor 234 sends a signal to the discrimination sensor 238 that a coin is approaching.

In the illustrated example, coins determined to be invalid are rejected by a diverting pin 242 that is lowered into the coin path such that the pin 242 impacts the invalid coin and thereby redirects the invalid coin to a reject channel 244. In some embodiments, the reject channel 244 guides the rejected coins to a reject chute that returns the coin to the user (e.g., rejected coins ejected into the coin reject tube 33 to the coin dispensing receptacle 22 of FIG. 1). The diverting pin 242 depicted in FIG. 5 remains in a retracted "non-diverting" position until an invalid coin is detected. Those coins not diverted into the reject channel 244 continue along inner queuing wall 270 to a gauging region 250. The inner queuing wall 270 terminates just downstream of the reject channel 244; thus, the coins no longer abut the inner queuing wall 270 at this point and the queuing channel 266 terminates. The radial position of the coins is maintained, because the coins remain under pad pressure, until the coins contact an outer wall 252 of the gauging region 250.

The gauging wall 252 aligns the coins along a common outer radius as the coins approach a series of coin exit channels 261-268 which discharge coins of different denominations through corresponding exit stations 281-288. The first exit channel 261 is dedicated to the smallest coin to be sorted (e.g., the dime in the U.S. coin set). Beyond the first exit channel 261, the sorting head 212 shown in FIGS. 4 and 5 forms seven more exit channels 262-268 which discharge coins of different denominations at different circumferential locations around the periphery of the sorting head 212. Thus, the exit channels 261-268 are spaced circumferentially around the outer periphery of the sorting head 212 with the innermost edges of successive channels located progressively closer to the center of the sorting head 212 so that coins are discharged in the order of increasing diameter. The number of exit channels can vary according to alternative embodiments of the present disclosure.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 218. To maintain a constant radial position of the coins, the pad 218 continues to exert pressure on the coins as they move between successive exit channels 261-268.

Further details of the operation of the sorting head 212 shown in FIGS. 4 and 5 are disclosed in U.S. Patent Application Publication No. US 2003/0168309 A1, which is incorporated herein by reference in its entirety. Other disk-type coin processing devices and related features that may be suitable for use with the coin processing devices disclosed herein are shown in U.S. Pat. Nos. 6,755,730; 6,637,576; 6,612,921; 6,039,644; 5,997,395; 5,865,673; 5,782,686; 5,743,373; 5,630,494; 5,538,468; 5,507,379; 5,489,237; 5,474,495; 5,429,550; 5,382,191; and 5,209,696, each of which is incorporated herein by reference in its entirety and for all purposes. In addition, U.S. Pat. Nos. 7,188,720 B2, 6,996,263 B2, 6,896,118 B2, 6,892,871 B2, 6,810,137 B2, 6,748,101 B1, 6,731,786 B2, 6,724,926 B2, 6,678,401 B2, 6,637,576 B1, 6,609,604, 6,603,872 B2, 6,579,165 B2, 6,318,537 B1, 6,171,182 B1, 6,068,194, 6,042,470, 6,039,645, 6,021,883, 5,982,918, 5,943,655, 5,905,810, 5,564,974, and 4,543,969, and U.S. Patent Application Publication Nos. 2007/0119681 A1 and 2004/0256197 A1, are incorporated herein by reference in their respective entireties and for all purposes.

Figure 6:
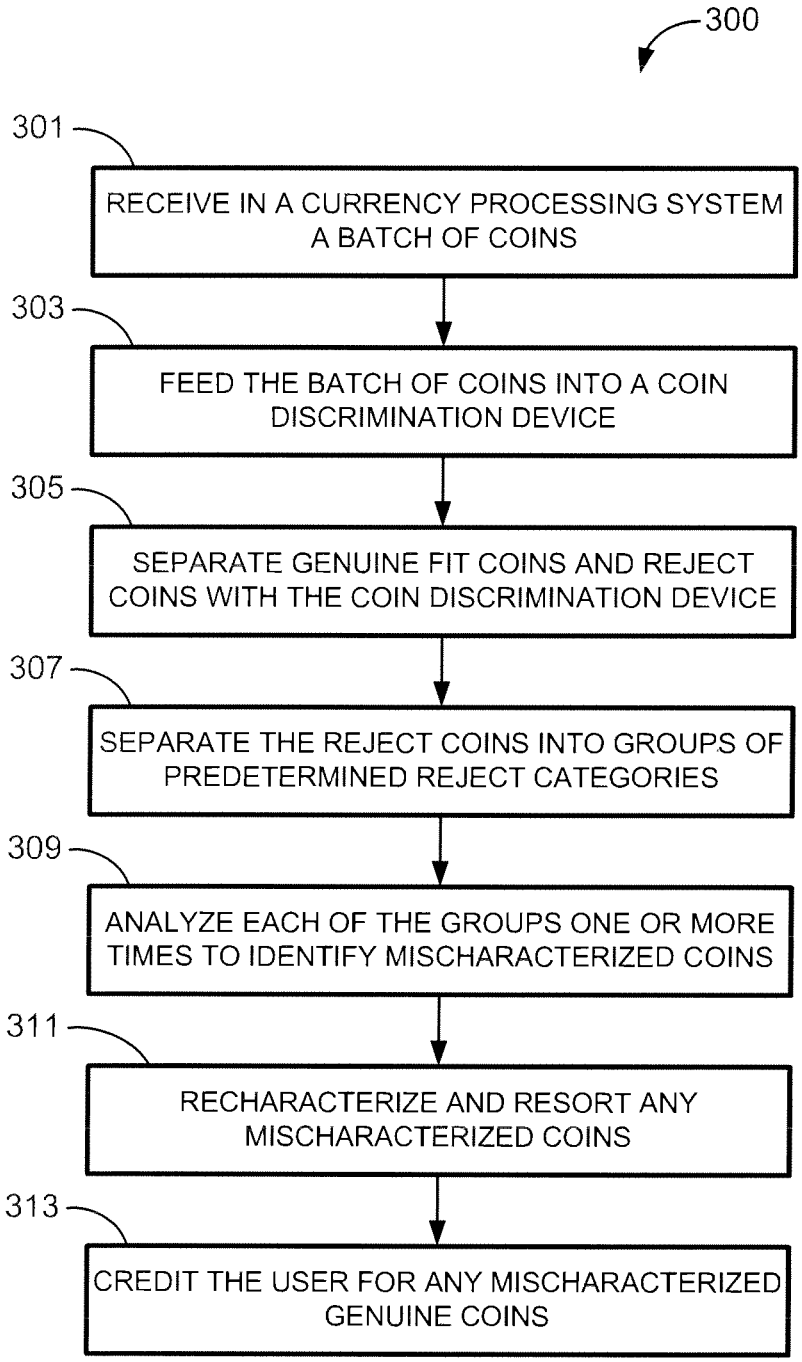
FIG. 6 is a flowchart for a representative method for managing reject coins or a representative algorithm that corresponds to instructions which can be stored on one or more non-transitory computer-readable media and can be executed by one or more controllers in accord with aspects of the disclosed concepts.

With reference now to the flow chart of FIG. 6, an improved method for managing coins processed by a coin processing unit of a currency processing system or machine, such as those shown in FIGS. 1-5, for example, is generally described at 300 in accordance with aspects of the present disclosure. FIG. 6 can be representative of an algorithm that corresponds to at least some instructions that can be stored, for example, in a main memory and executed, for example, by a central processing unit (CPU) (FIG. 2) to perform any or all of the above or below described functions associated with the disclosed concepts. The method 300 will be described with reference to the various aspects and features shown in FIGS. 1-5 and 7-11 of the drawings; such reference is being provided purely by way of explanation and clarification.

Disclosed herein are automated systems, devices and methods for managing rejected genuine coins, both fit and unfit, without compromising the precision and sensitivity needed to reject counterfeit and stranger coins. As indicated above in the discussion of the representative currency processing system illustrated in FIG. 3, for example, a user deposits a batch of mixed coins into the coin tray 112 of the coin processing machine 100 (e.g., Step 301). Contemporaneous with the deposit, a signal may be transmitted to the onboard CPU that coins have received from the user and the user would like to begin processing the coin batch. Such transmission may be generated responsive to the user entering personal information or otherwise activating the machine 100 via user interface 118 (FIG. 3). Alternatively, one or more sensors may detect the presence of the coins and output a signal indicative thereof to the CPU. The coin tray 112 may be configured to transfer coins deposited thereon, e.g., by pivoting upwards and/or by downwardly sloping coin surfaces, to a coin sorting mechanism (e.g., coin processing unit 200 of FIG. 4) disposed within a cabinet or housing 104 (e.g., Step 303). After some or all of the coins within the coin tray 112 are transferred to the sorting mechanism through the coin input area 116 of the cabinet 104, coin processing is initiated, either automatically by the machine 100 or in response to a user input (e.g., Step 305).

During processing, the coin batch is first separated into at least two distinct groups: genuine fit target coins (e.g., valid coins) and reject coins (e.g., invalid coins), as indicated at step 305 in FIG. 6. Subsequently, at Step 307, the reject coins are separated into predefined reject groups, each of which corresponds to a respective category of rejected coins. In some embodiments, the coin processing system 300 is provided with at least two modes of operation during coin sorting. The first mode, which can be used during an initial analysis or "first pass" of processing, utilizes a heightened or a highest sensitivity level for detection of all invalid coins (e.g., stranger and counterfeit coins). Modern sensors are typically electronic devices that measure or detect an input quantity (e.g., light, temperature, radiation, etc.) and convert it into an electrical signal which can be read by an instrument. Almost all sensors are designed to work over a specified range. Sensitivity of a sensor can be defined as the change in output of the sensor per unit change in the parameter being measured. The factor may be constant over the range of the sensor (linear) or it may vary (nonlinear). As an optional or alternative means of changing sensor sensitivity levels for the various operating modes, one or more sensors can be activated to increase the sensor sensitivity level or, alternatively, one or more sensors can be deactivated to decrease the sensor sensitivity level. The first mode may optionally include changing the parameters of the coin detection system.

As a non-limiting example of the aforementioned first operating mode, the coin discriminating sensor or sensors, which may typically operate at a "default" sensitivity level of 70 on a range of 1-100, can be increased ~20% to 85 for the first mode. During the first operating mode, valid coins will pass without being rejected by the diverting pin 242 shown in FIG. 5 and are processed accordingly (e.g., sorted by denomination and deposited into a corresponding bag or bin). All invalid coins, on the other hand, can be rejected by the diverting pin 242 and deposited into a single or multiple temporary escrows with means to transport them back into the hopper. The sensor sensitivity levels can be based, in whole or in part, on customer specification, regulatory requirements, etc.

Once the first pass has been completed and the valid coins (e.g., genuine target coins) are sorted, the rejected coins are physically separated into two or three or more predefined categories. These predefined categories can include, for example: a first reject category comprising counterfeit coins and stranger coins (i.e., coins not of the target coin set); a second reject category comprising rejected coins that "appear to be" genuine and fit; and a third reject category comprising rejected coins that are genuine but exhibit unfit characteristics. Optionally, the first reject category can be separated into two separate rejected coin groups, one of which consists of counterfeit coins and one which consists of stranger coins. To determine which reject coins are sorted into which of the three predefined reject categories may comprise assessing a physical characteristic of the reject coins that was not assessed during the first pass of processing. By way of example, the coin batch may initially be sorted into valid coins and reject coins based on coin diameter and surface characteristic; the reject coins may then be sorted into reject groups based on metallurgical characteristics of the coins. Alternatively, the sensor sensitivity level may be modulated after the first pass of processing to determine sort the reject coins into the predetermined reject categories.

At Step 309 in FIG. 6, one or more or all of the reject groups are analyzed to determine if any of the coins contained therein were mischaracterized and, thus, erroneously sorted as a "reject" coin. By way of non-limiting example, the first group comprising stranger and counterfeit coins may be sent through the coin processing unit for one additional "precautionary" pass using the first mode sensor sensitivity levels to ensure that no genuine coins were erroneously designated as stranger or counterfeit. After this optional precautionary pass, the first group comprising stranger and counterfeit coins can be physically separated (e.g., outsorted to a coin receptacle dedicated to invalid coins) for subsequent removal and disposal. The second group comprising coins that "appear to be" genuine and fit is analyzed again. This may include running the second group through the coin sorting unit for two or three or more additional passes using the first mode sensor sensitivity levels or a slightly reduced sensitivity level (e.g., sensitivity level of 80). For some implementations, the analysis is limited to a maximum of three additional passes. Any genuine coins remaining as rejects after these additional passes are removed and returned to a mint or central bank.

In contrast to the first and second groups of coins, the third group is analyzed at least one additional time—sent through a "second pass" of processing—utilizing a second mode of operation that is engaged on the coin processing machine 100. This second mode would utilize a reduced sensitivity level or desensitized settings that would enable various levels of unfit genuine coins to be processed through the machine for valuation. As a non-limiting example, the coin discriminating sensor or sensors, which may typically operate at a "default" sensitivity level of 70 on a range of 1-100, can be decreased by ~7% to 65 for the first mode. The sensor sensitivity level can be based, in whole or in part, on a customer's desired results as tested based on running a control test batch. The method 300 may further comprise recharacterizing any coins that were mischaracterized and erroneously sorted as a "reject" coin, as indicated at Step 311. At Step 313, the customer would also be credited for any validated genuine unfit coins without reintroducing them back into circulation. Alternatively, some or all of these coins could be reintroduced into circulation if desired. Crediting may include increasing the input totals and directing a commensurate increase in funds output, for example, via a funds dispensing module. The total value of the processed batch of coins, which can be redeemed, for example, via a printed receipt, can be adjusted in accordance with any validated genuine unfit coins and any reject coins determined to be valid and genuine. The result of this process is successful removal of stranger coins and counterfeit coins while providing automatic credit to a customer for all genuine coins, whether deemed to be fit or unfit.

For some embodiments, the foregoing practice of analyzing rejected coins multiple times and, after the final analysis, characterizing or recharacterizing any remaining rejected coins as genuine fit, genuine unfit, stranger, counterfeit, etc., is fully automated. As one non-limiting example, rejected coins remaining at the end of batch processing are automatically transported from a reject receptacle back into the sorting and authentication mechanism without attendant intervention. Rather than transfer rejects to and from a reject receptacle, another option is to hold rejected coins within the sorting and authentication unit of the machine and automatically run them one or more additional times. As yet a further option, the reject coins can be transferred to a dedicated auxiliary reject coin processing unit for subsequent analysis, as will be discussed in extensive detail hereinbelow. For some embodiments, one or more of the steps associated with the above methodology can be performed manually.

Coins processed at cash-in-transit (CIT) machines come from a variety of sources, including coin redemption machines, vending machines, cash tills, fare boxes, and other miscellaneous sources. Coins originating from many modern coin redemption machines and vending machines are typically quite "clean" from damaged and unfit coins, counterfeit coins, and stranger coins. Consequently, to process these coins at the CIT in the most productive manner, the coin processing machine can be configured with a third mode of operation where the coin discrimination is desensitized resulting in the fewest number of genuine coin false rejects This sensor sensitivity level can be set to be lower than that of the second mode described above. Optionally or alternatively, the coins can be sorted based on assessment of coin diameter while the sensor system, which may assess surface characteristics or metallurgical properties, is turned off. An optional fourth mode of operation for the CIT enables a higher or highest sensitivity setting for processing coins received from cash tills or other equipment that typically do not have sophisticated coin detection capabilities. This sensor sensitivity level can be set to be higher than that of the first mode described above. Any of the disclosed modes of operation—e.g., the first, second, third and fourth modes described above—may be made "user selectable." For instance, the user is then allowed to select from the various modes of operation to thereby choose the level of sensitivity most befitting for processing each batch based, at least in part, on the origin of the coins being processed.

Some coin processing operations, such as a mint operation or a CIT purchasing newly minted coins, for example, process coins that are known to contain zero stranger coins, counterfeit coins, and unfit coins. While some or all of these coins might have been circulated, they are for all intents and purposes "clean." For such applications, the coin processing machine may be configured with a special mode of operation that would minimize, defeat, or otherwise deactivate the coin authentication and fitness detection capabilities. Conversely, some coin processing operations may process coins that are known to contain an inordinately high number of stranger and counterfeit coins. For these applications, the coin processing machine may be configured with another special mode of operation that would maximize the coin authentication and fitness detection capabilities of the coin processing unit.

One potential problem associated with a separate mode of operation that desensitizes coin detection for the purpose of accepting more coins is that such desensitizing may contravene or negate machine certification for compliance with local regulations. As one example, machines sold in the Eurozone must have European Central Bank (ECB) certification that the product in question has been tested by the ECB to confirm the counterfeit detection accuracy of the device meets an established minimum. However, some certifications are focused primarily or solely on high value coins—e.g., ECB certifications are focused on 0.5€, 1€ and 2€ coins. For such applications, the user may be restricted from using a desensitized mode of operation (e.g., a reduced sensitivity level) for these particular "high value" denominations, but would be allowed to implement this mode of operation for the other denominations in the target coin set or for coin sets that are not subject to such regulations. These regulations will typically vary from jurisdiction to jurisdiction. For example, Russian regulations apply equally to their entire spectrum of coins. As such, sensory sensitivity levels, regardless of mode of operation, must comply with local Russian regulations.

An optional or alternative approach to desensitizing the entire detection system to coin fitness characteristics when attempting to determine authentication is to combine multiple sensing technologies into a coin processing system such that fitness and authenticity can each be assessed at a distinct level of sensitivity. For example, one or more imaging sensors could be applied to the coin detection system for identifying fit coins versus unfit coins. This information could be combined with metallurgical detection technology (e.g., data from one or more Eddy current sensors) to authenticate the coin. In so doing, the sensitivity of the imaging sensors for the fitness analysis can be increased or decreased without changing the sensitivity of the Eddy current sensors for the authentication analysis, and vice versa. Optionally, multiple identical or dissimilar sensors could be combined into a sensor array such that one or more of the sensors can be desensitized for fitness characteristics while the sensitivity of one or more of the sensors in the array is maintained or increased for purposes of coin authentication.

As an optional or alternative approach for managing rejected coins, an auxiliary device dedicated to analyzing reject coins is operatively connected (e.g., via a conveyor system) to the coin processing machine to provide a static or dynamic look at each rejected coin for the purpose of authentication, fitness and/or any other type of validation. For some embodiments, the auxiliary device utilizes Eddy current technology in a static fashion where the coin is presented to one or more Eddy current sensors and held in place until the device completes testing and provides a pass/fail or other predefined response is received from the sensor(s). Similar to the static method, the coin could be presented dynamically across the face of the Eddy current sensor or a group of sensors and once the system completes testing a pass/fail or other predefined response is provided by the system. This method might include a number of different configurations for consistently presenting the coin to the sensor in the auxiliary device, including fixtures and holding devices that translate the coin in relation to the sensor in a number of different orientations. Alternative sensing methods might include remnant sensing technology, pulse Eddy current sensing technology, or other detection methods that are better suited for static detection versus dynamic detection. These may include weighing each coin, conducting other dimensional analysis of each coin, or evaluating the construction of each coin.

The static method of reject coin analysis might also include auxiliary devices capable of attaining a magnetic response from the coin to verify its magnetic properties. A high resolution imaging sensor with detailed image processing is an alternative method of auxiliary authentication where a very detailed image analysis could be performed for the purposes of authentication. The image processing detection could include looking at all physical characteristics of the coin including the edge of the coin. Each of the foregoing detection techniques would interface with the embedded control of the coin processing unit to provide an automated solution for adding and/or subtracting from the batch and bag totals. In addition to managing rejected coins, the same devices could be used for higher precision confirmation of authentic coins that were accepted by the coin processing unit. The auxiliary device can, in some applications, operate at a much slower speed than the primary sorting device as it would not need to process the high volume of coin, only rejected coin. Optionally, an auxiliary authentication device can be incorporated within each denomination path (e.g., at the exit stations 281-288 in FIG. 5) leading to the coin containers (e.g., coin receptacles 108A-H of FIG. 3).

In some embodiments, an auxiliary reject coin marking device is provided for the coin processing device that would generate and attach to each rejected coin a unique identifier, such as a serial number or bar code. With this method, any coins that are rejected would be processed, serialized or otherwise marked, the coin thereby attached to or otherwise associated with a customer's batch or account, and subsequently sent to a central bank or mint for authentication. Once the authenticity of the coin has been determined, feedback is provided and the serial number/unique identifier of the coin is designated as either genuine or counterfeit. Since the coin with serial number/unique identifier has been associated with a customer's batch/account, the customer could be credited or debited based on the authenticity determination. This provides traceability of rejected coins in a manageable manner that currently does not exist. Another method that may be utilized in addition to or in lieu of a serialized application might be to "finger print" the coin by capturing a high-resolution detailed image of the coin. For example, a high resolution image taken of a given coin could be unique and mapped similar to a fingerprint. Alternative methods might include use of a sticker, RFID tag, or any other method of attaching indicia to the coin that would contain a unique identifier.

The auxiliary marking device can also be applied to self-service coin redemption machines. After the rejected coins are identified and retained in the coin processing machine, an image is taken of the patron for the purposes of attaching the "serial numbered" coins to the patron. This could be used for identification of criminal counterfeiting activity and traceability. The same method could be applied to stranger coins where a patron is deliberately trying to fool the detection system in a self-service coin machine utilizing stranger coins from other countries. This can help to address some of the challenges associated with stranger coins that have the same metallurgical and physical characteristics as the genuine coins in a given country.

An optional configuration for automatically managing detailed analysis of rejected coins is to provide, internally within a coin processing machine, a static authentication device to which rejected coins are diverted, analyzed, and then either reintroduced into the sorting mechanism for transport to valid coin receptacle(s) or transported to reject coin receptacle(s). Another approach is to stop the sorting mechanism when encountering a coin that appears to be counterfeit and perform a more detailed (static or dynamic) analysis and then resume sorting once the analysis is complete.

In some embodiments, the coin processing machine could incorporate a mode where an attendant has the ability to add to the denomination totals after a visual inspection of rejected coins reveals additional authentic coins. By way of non-limiting example, when a coin is identified and rejected, the machine can be configured to image the rejected coin and present the image on a graphical user interface (GUI), along with the denomination to which that coin was compared, and a selectable option of whether the coin is authentic or stranger/counterfeit. The attendant would, upon inspection of the coin utilizing any of the disclosed methods, provide an answer to the question presented on the GUI. If the coin is designated as authentic by the attendant, the coin would be added to batch and bag totals and the user credited accordingly. When the denomination totals are increased, the corresponding coins could be manually added to the coin receptacles of the coin processing machine. If the coin is designated as stranger/counterfeit by the attendant, the machine continues normal operation and the coin is added to the reject container total.

For continuous uninterrupted operation, the machine can be configured to wait until processing of the batch is complete and, optionally, an "end" button is pressed by a user or attendant. The user interface screen would then present images for all of the rejected coins that were not included in the batch total. The attendant would then inspect each of the rejected coins and manually add to appropriate denominations coins they wish to include in the batch total. Once this operation is completed, the batch processing is ended and the coins are added to the appropriate container. This method could be used in conjunction with the auxiliary authentication methods disclosed herein.

For some embodiments, the coin processing machine may be provided with multiple reject containers, wherein one or more of the reject containers stow stranger and unfit coins, while one or more of the reject containers stow only counterfeit coins. The machine can also be set up with confidence thresholds for making the determination as to whether a coin is counterfeit or unfit and, thus, into which container to direct each coin.

In order to properly denominate a batch of coins, it is important that each coin be presented to the discrimination sensor or sensor array in a consistent manner. Unfit coins that are bent or damaged can compromise this requirement. One solution is to provide relief in the sort head around the detection area that would allow a bent or damaged coin to properly and consistently interface with the sensor.

Figure 7:
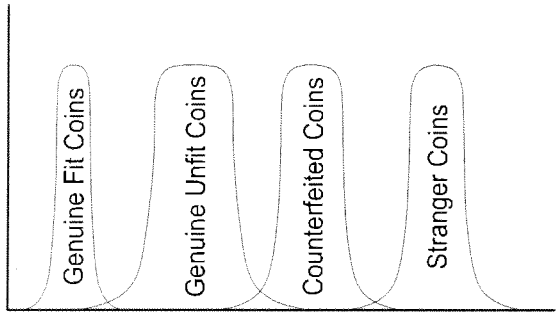
FIG. 7 is a chart illustrating a first example of a Coin Management Concept (CMC) in accord with aspects of the disclosed concepts.

According to some embodiments, multiple sensors are employed to interrogate each coin in the coin processing machine, auxiliary device, reconciliation station, or equivalent device. These sensors can include optical sensors, magnetic sensors, eddy current sensors, capacitive sensors, or other sensors, or any combination thereof. Each sensor is configured to test a different property of the coin; these coin properties are then used to separate the coins into at least four groups each corresponding to a predetermined category of coins: genuine fit target coins, genuine unfit target coins, counterfeits coins, and strangers (which can include foreign objects that do not belong to a specific coin set). The set of coin property parameters (CPP) used to classify a coin into one specific group could be different from the set of parameters to classify the coin into a different group. As shown in FIG. 7, an ideal outcome of at least one Coin Management Concept (CMC) is to achieve complete and accurate separation of coins into these four predetermined groups. However, there may be cases in which there is an overlap.

Figure 8:
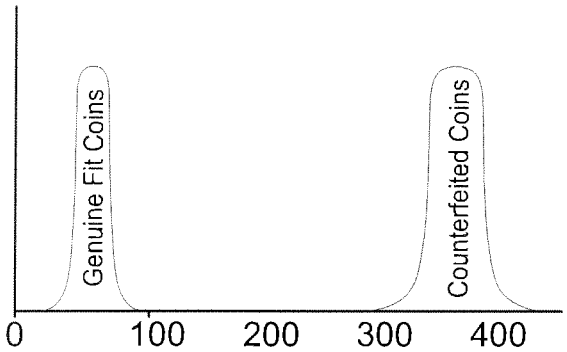
FIG. 8 is a chart illustrating a second example of a Coin Management Concept (CMC) in accord with aspects of the disclosed concepts.

The graph in FIG. 8 is an example of implementation of another CMC operation to separate genuine fit coins from counterfeits. In this particular example, coins with a CPP score of less than 100 will be classified as genuine fit and, for example, diverted to a "genuine fit" output receptacle in the machine. Conversely, coins with a CPP score 280 to 450 will be classified as counterfeits and, for example, diverted to a "counterfeit" output receptacle in the machine. The "score" numbers shown above as examples will depend, for example, on the coin issuing country, denomination, specific properties and other factors.

Figure 9:
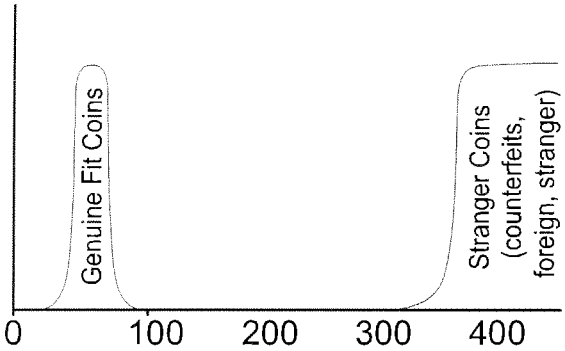
FIG. 9 is a chart illustrating a third example of a Coin Management Concept (CMC) in accord with aspects of the disclosed concepts.

In yet another implementation of the Coin Management Concept, which is exemplified in FIG. 9, the same or different sets of coin properties parameters (CPP) are used to separate genuine fit coins from other coins including counterfeits, strangers, foreign and/or certain types of genuine unfit coins. In the implementation schematically described above, there is no upper limit for the coin property parameters (CPP) and all coins "scoring" above 280 will belong to the latter of the above-mentioned categories.

Figure 10:
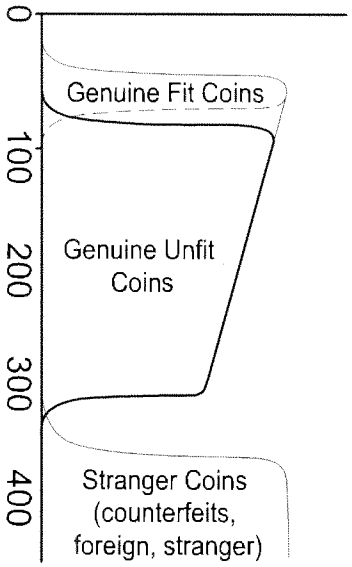
FIG. 10 is a chart illustrating a fourth example of a Coin Management Concept (CMC) in accord with aspects of the disclosed concepts.

Shown in FIG. 10 is yet another implementation of the Coin Management Concept (CMC) whereby genuine unfit-for-circulation coins are separated from genuine fit coins and from counterfeit, stranger and foreign coins. In this example, all coins scoring between, for example, 100 and 300 will be classified as genuine unfit coins. However, it is possible that the CPP score for some of the unfit coins will be above 280 and such coins will be rejected into the stranger or counterfeits output.

Figure 11:
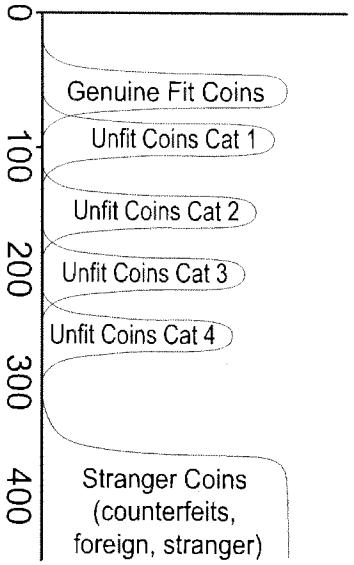
FIG. 11 is a chart illustrating a fifth example of a Coin Management Concept (CMC) in accord with aspects of the disclosed concepts.

In yet another implementation of the CMC, based on yet another CPP scheme, the unfit coins could be separated in to multiple categories based on certain fitness criteria, as seen in FIG. 11. It should be obvious to person skilled in the art that similar CMC concept could be used to manage different categories of coins which initially fall into Stranger category. This will allow separation into counterfeits, foreign coins strangers, a for example severely damaged, unfit coins. As it was disclosed in the invention disclosure, the final separation of coins using the CMC could be based on testing them using different means such as different machines, different CPP, different speeds, and other means.

In some embodiments, the method includes at least those steps enumerated in FIG. 6, which may further comprise some or all of those steps described above, or any combination thereof. It is also within the scope and spirit of the present invention to omit steps, include additional steps, and/or modify the order presented above. It should be further noted that the foregoing method can be representative of a single sequence for managing processed coins. However, it is expected that the method will be practiced in a systematic and repetitive manner.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including tabletop devices, multiprocessor systems, microprocessor-based or programmable-consumer electronics, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A method for managing banknotes processed by an automated currency processing system, the method comprising:

receiving a batch of banknotes via a banknote input area of the currency processing system;

feeding the batch of banknotes into a banknote processing unit of the currency processing system, the banknote processing unit including one or more banknote discriminating sensors;

sorting the batch of banknotes into genuine fit target banknotes and reject banknotes with the banknote processing unit;

sorting the reject banknotes into a plurality of reject groups with the banknote processing unit, each of the reject groups corresponding to a respective category of rejected banknotes;

analyzing, via one or more processors and the one or more banknote discriminating sensors, at least one of the reject groups to determine if any genuine target banknotes were mischaracterized and erroneously sorted into the at least one reject group; and crediting, via the one or more processors, a user of the currency processing system for the genuine target banknotes in the at least one reject group determined to have been mischaracterized and erroneously sorted.

2. The method of claim 1, wherein the sorting the batch of banknotes into genuine fit target banknotes and reject banknotes is performed with the currency processing system set in a first mode of operation, the first mode of operation including increasing a sensitivity level of at least one of the one or more banknote discriminating sensors in the banknote processing unit to an increased sensitivity level.

3. The method of claim 2, wherein the sorting the reject banknotes into the plurality of reject groups is performed with the currency processing system set in a second mode of operation, the second mode of operation including decreasing a sensitivity level of at least one of the one or more banknote discriminating sensors in the banknote processing unit to a decreased sensitivity level, the decreased sensitivity level being less than the increased sensitivity level.

4. The method of claim 1, wherein the plurality of reject groups includes a first reject group comprising stranger and counterfeit banknotes, a second reject group comprising rejected banknotes appearing to be genuine and fit, and a third reject group comprising genuine banknotes exhibiting unfit characteristics.

5. The method of claim 4, wherein the analyzing at least one of the reject groups includes resorting the second reject group comprising rejected banknotes appearing to be genuine and fit into genuine fit target banknotes and reject banknotes by passing the second reject group through the banknote processing unit multiple additional times.

6. The method of claim 4, wherein the analyzing at least one of the reject groups includes passing the third reject group comprising genuine banknotes exhibiting unfit characteristics through the banknote processing unit while operating with desensitized settings operable to enable various levels of unfit genuine banknotes to be valuated.

7. The method of claim 4, further comprising transporting the first reject group comprising stranger and counterfeit banknotes to a banknote receptacle of the currency processing system dedicated to invalid banknotes.

8. The method of claim 1, wherein the banknote processing unit is operable in any of a plurality of user-selectable modes of operation, each of the user-selectable modes of operation corresponding to a distinct sensitivity level of the one or more banknote discriminating sensors in the banknote processing unit, the method further comprising receiving from a user a selection of at least one of the user-selectable modes of operations.

9. The method of claim 8, wherein at least one of the user-selectable modes of operation and the corresponding distinct sensitivity level thereof is based, at least in part, on the origin of the batch of banknotes being processed.

10. The method of claim 8, wherein at least one of the user-selectable modes of operation deactivates banknote authentication and fitness detection capabilities of the banknote processing unit.

11. The method of claim 1, further comprising transporting the valid genuine banknotes in the at least one reject group to a banknote receptacle of the currency processing system associated with valid genuine banknotes.

12. The method of claim 1, wherein the one or more banknote discriminating sensors of the banknote processing unit include at least one sensor dedicated to assessing banknote fitness and at least one sensor dedicated to assessing banknote authenticity, and wherein the analyzing at least one of the reject groups includes decreasing a sensitivity level of the at least one sensor dedicated to assessing banknote fitness without desensitizing the at least one sensor dedicated to banknote authenticity.

13. The method of claim 1, wherein the analyzing the at least one reject group is performed by an auxiliary device operatively connected to the banknote processing unit, the auxiliary device being dedicated to analyzing the reject banknotes in the reject groups.

14. A method for managing banknotes processed by an automated currency processing system, the method comprising:

receiving a batch of banknotes via a banknote input area of the currency processing system;

feeding the batch of banknotes into a banknote processing unit of the currency processing system, the banknote processing unit including one or more banknote discriminating sensors;

sorting the batch of banknotes into genuine banknotes and reject banknotes with the banknote processing unit;

categorizing the reject banknotes into a plurality of reject groups with the banknote processing unit, each of the reject groups corresponding to a respective category of rejected banknotes;

analyzing, via one or more processors and the one or more banknote discriminating sensors, at least one of the reject groups to determine if any genuine target banknotes were mischaracterized and erroneously categorized into the at least one reject group; and crediting, via the one or more processors, a user of the currency processing system for the genuine target banknotes in the at least one reject group determined to have been mischaracterized and erroneously sorted.

15. The method of claim 14, wherein the sorting the batch of banknotes into genuine banknotes and reject banknotes is performed with the currency processing system set in a first mode of operation, the first mode of operation including increasing a sensitivity level of at least one of the one or more banknote discriminating sensors in the banknote processing unit to an increased sensitivity level.

16. The method of claim 15, wherein categorizing the reject banknotes into a plurality of reject groups is performed with the currency processing system set in a second mode of operation, the second mode of operation including decreasing a sensitivity level of at least one of the one or more banknote discriminating sensors in the banknote processing unit to a decreased sensitivity level, the decreased sensitivity level being less than the increased sensitivity level.

17. The method of claim 14, wherein the plurality of reject groups includes a first reject group comprising stranger and counterfeit banknotes, a second reject group comprising rejected banknotes appearing to be genuine and fit, and a third reject group comprising genuine banknotes exhibiting unfit characteristics.

18. The method of claim 17, wherein the analyzing at least one of the reject groups includes re-categorizing the second reject group comprising rejected banknotes appearing to be genuine and fit into genuine fit target banknotes and reject banknotes by passing the second reject group through the banknote processing unit multiple additional times.

19. The method of claim 17, wherein the analyzing at least one of the reject groups includes passing the third reject group comprising genuine banknotes exhibiting unfit characteristics through the banknote processing unit while operating with desensitized settings operable to enable various levels of unfit genuine banknotes to be valuated.

20. The method of claim 17, further comprising transporting the first reject group comprising stranger and counterfeit banknotes to a banknote receptacle of the currency processing system dedicated to invalid banknotes.

21. The method of claim 14, wherein the banknote processing unit is operable in any of a plurality of user-selectable modes of operation, each of the user-selectable modes of operation corresponding to a distinct sensitivity level of the one or more banknote discriminating sensors in the banknote processing unit, the method further comprising receiving from a user a selection of at least one of the user-selectable modes of operations.

22. The method of claim 21, wherein at least one of the user-selectable modes of operation and the corresponding distinct sensitivity level thereof is based, at least in part, on the origin of the batch of banknotes being processed.

23. The method of claim 21, wherein at least one of the user-selectable modes of operation deactivates banknote authentication and fitness detection capabilities of the banknote processing unit.

24. The method of claim 14, further comprising transporting the valid genuine banknotes in the at least one reject group to a banknote receptacle of the currency processing system associated with valid genuine banknotes.

25. The method of claim 14, wherein the one or more banknote discriminating sensors of the banknote processing unit include at least one sensor dedicated to assessing banknote fitness and at least one sensor dedicated to assessing banknote authenticity, and wherein the analyzing at least one of the reject groups includes decreasing a sensitivity level of the at least one sensor dedicated to assessing banknote fitness without desensitizing the at least one sensor dedicated to banknote authenticity.

26. The method of claim 14, wherein the analyzing the at least one reject group is performed by an auxiliary device operatively connected to the banknote processing unit, the auxiliary device being dedicated to analyzing the reject banknotes in the reject groups.

27. A currency processing system comprising:

a banknote input area configured to receive banknotes;

a plurality of banknote receptacles configured to receive and stow processed banknotes;

a banknote processing unit with one or more banknote discriminating sensors, the banknote processing unit being configured to receive banknotes from the banknote input area, process the banknotes, and output the processed banknotes to the banknote receptacles;

one or more processors; and one or more memory devices storing instructions that, when executed by at least one of the one or more processors, cause the one or more processors to:

receive a signal indicative of a batch of banknotes being received via the banknote input area;

receive a signal indicative of the batch of banknotes being fed into the banknote processing unit;

direct the banknote processing unit to sort the batch of banknotes into genuine fit target banknotes and reject banknotes;

direct the banknote processing unit to sort the reject banknotes into a plurality of reject groups, each of the reject groups corresponding to a respective category of rejected banknotes;

receive signals from the one or more banknote discriminating sensors indicative of banknote parameters of the reject banknotes in at least one of the reject groups;

determine if any genuine target banknotes were mischaracterized and erroneously sorted into the at least one reject group; and credit a user of the currency processing system for the genuine target banknotes in the at least one reject group determined to have been mischaracterized and erroneously sorted.

28. The currency processing system of claim 27, wherein the currency processing system is set in a first mode of operation when sorting the batch of banknotes into genuine fit target banknotes and reject banknotes, the first mode of operation including increasing a sensitivity level of at least one of the one or more banknote discriminating sensors in the banknote processing unit.

29. The currency processing system of claim 28, wherein the currency processing system is set in a second mode of operation when sorting the reject banknotes into the plurality of reject groups, the second mode of operation including decreasing a sensitivity level of at least one of the one or more banknote discriminating sensors in the banknote processing unit.

30. The currency processing system of claim 27, wherein the plurality of reject groups includes a first reject group comprising stranger and counterfeit banknotes, a second reject group comprising rejected banknotes appearing to be genuine and fit, and a third reject group comprising genuine banknotes exhibiting unfit characteristics.

31. The currency processing system of claim 30, wherein determining if any genuine target banknotes were mischaracterized and erroneously sorted includes resorting the second reject group comprising rejected banknotes appearing to be genuine and fit into genuine fit target banknotes and reject banknotes by passing the second reject group through the banknote processing unit multiple additional times.

32. The currency processing system of claim 30, wherein determining if any genuine target banknotes were mischaracterized and erroneously sorted includes passing the third reject group comprising genuine banknotes exhibiting unfit characteristics through the banknote processing unit while operating with desensitized settings operable to enable various levels of unfit genuine banknotes to be valuated.

33. The currency processing system of claim 27, wherein the banknote processing unit is operable in any of a plurality of user-selectable modes of operation, each of the user-selectable modes of operation corresponding to a distinct sensitivity level of the one or more banknote discriminating sensors in the banknote processing unit.

34. A currency processing system comprising:

a banknote input area configured to receive banknotes;

a banknote processing unit with one or more banknote discriminating sensors, the banknote processing unit being configured to receive banknotes from the banknote input area, process the banknotes, and output the processed banknotes;

one or more processors; and one or more memory devices storing instructions that, when executed by at least one of the one or more processors, cause the one or more processors to:

receive a signal indicative of a batch of banknotes being received via the banknote input area;

receive a signal indicative of the batch of banknotes being fed into the banknote processing unit;

direct the banknote processing unit to sort the batch of banknotes into genuine banknotes and reject banknotes;

direct the banknote processing unit to categorize the reject banknotes into a plurality of reject groups, each of the reject groups corresponding to a respective category of rejected banknotes;

receive signals from the one or more banknote discriminating sensors indicative of banknote parameters of the reject banknotes in at least one of the reject groups;

determine if any genuine target banknotes were mischaracterized and erroneously sorted into the at least one reject group; and credit a user of the currency processing system for the genuine target banknotes in the at least one reject group determined to have been mischaracterized and erroneously sorted.

35. The currency processing system of claim 34, wherein the currency processing system is set in a first mode of operation when sorting the batch of banknotes into genuine banknotes and reject banknotes, the first mode of operation including increasing a sensitivity level of at least one of the one or more banknote discriminating sensors in the banknote processing unit.

36. The currency processing system of claim 35, wherein the currency processing system is set in a second mode of operation when sorting the reject banknotes into the plurality of reject groups, the second mode of operation including decreasing a sensitivity level of at least one of the one or more banknote discriminating sensors in the banknote processing unit.

37. The currency processing system of claim 34, wherein the plurality of reject groups includes a first reject group comprising stranger and counterfeit banknotes, a second reject group comprising rejected banknotes appearing to be genuine and fit, and a third reject group comprising genuine banknotes exhibiting unfit characteristics.

38. The currency processing system of claim 37, wherein determining if any genuine target banknotes were mischaracterized and erroneously categorized includes re-categorizing the second reject group comprising rejected banknotes appearing to be genuine and fit into genuine fit target banknotes and reject banknotes by passing the second reject group through the banknote processing unit multiple additional times.

39. The currency processing system of claim 37, wherein determining if any genuine target banknotes were mischaracterized includes passing the third reject group comprising genuine banknotes exhibiting unfit characteristics through the banknote processing unit while operating with desensitized settings operable to enable various levels of unfit genuine banknotes to be valuated.

40. The currency processing system of claim 34, wherein the banknote processing unit is operable in any of a plurality of user-selectable modes of operation, each of the user-selectable modes of operation corresponding to a distinct sensitivity level of the one or more banknote discriminating sensors in the banknote processing unit.

* * * * *